US008944498B2

(12) United States Patent
Lawson

(10) Patent No.: US 8,944,498 B2
(45) Date of Patent: Feb. 3, 2015

(54) LINKAGE MECHANISM FOR A DUAL-MOTOR LIFTING RECLINER

(75) Inventor: Gregory M. Lawson, Tupelo, MS (US)

(73) Assignee: L & Property Management Company, South Gate, CA (US)

( * ) Notice: Subject to any disclaimer, the term of this patent is extended or adjusted under 35 U.S.C. 154(b) by 198 days.

(21) Appl. No.: 13/344,330

(22) Filed: Jan. 5, 2012

(65) Prior Publication Data

US 2013/0175847 A1 Jul. 11, 2013

(51) Int. Cl.
*A47C 1/035* (2006.01)

(52) U.S. Cl.
USPC ..... 297/85 M; 297/85 L; 297/DIG. 10

(58) Field of Classification Search
USPC ..... 297/85 M, 85 R, DIG. 10
See application file for complete search history.

(56) References Cited

U.S. PATENT DOCUMENTS

| | | | |
|---|---|---|---|
| 3,084,974 | A | 4/1963 | Belisle et al. |
| 3,138,402 | A | 6/1964 | Heyl, Jr. |
| 3,233,938 | A | 2/1966 | Fletcher |
| 3,622,198 | A | 11/1971 | Re |
| 3,747,973 | A | 7/1973 | Re |
| 3,813,150 | A | 5/1974 | Katz et al. |
| 3,958,827 | A | 5/1976 | Re |
| 4,083,599 | A | 4/1978 | Gaffney |
| 4,195,878 | A | 4/1980 | Caldwell et al. |
| 4,216,991 | A | 8/1980 | Holobaugh |
| 4,306,746 | A | 12/1981 | Crum |
| 4,365,836 | A | 12/1982 | Jackson et al. |
| 4,418,957 | A | 12/1983 | Rogers, Jr. |
| 4,707,025 | A | 11/1987 | Rogers, Jr. |
| 4,740,031 | A | 4/1988 | Rogers |
| 4,786,107 | A | 11/1988 | Crockett |
| 4,852,939 | A | 8/1989 | Krauska |
| 5,072,988 | A | 12/1991 | Plunk |
| 5,076,644 | A | 12/1991 | Northcutt |

(Continued)

FOREIGN PATENT DOCUMENTS

| | | |
|---|---|---|
| EP | 0468686 A1 | 1/1992 |
| EP | 2368458 A1 | 9/2011 |
| GB | 926157 | 5/1963 |

OTHER PUBLICATIONS

Non-Final Office Action in related U.S. Appl. No. 13/344,215, mailed Jun. 5, 2013, pp. 1-19.

(Continued)

*Primary Examiner* — David R Dunn
*Assistant Examiner* — Tania Abraham
(74) *Attorney, Agent, or Firm* — Shook, Hardy & Bacon L.L.P.

(57) ABSTRACT

A seating unit that includes a linkage mechanism adapted to move the seating unit between closed, extended, reclined, and seat-lift positions is provided. The linkage mechanism includes a footrest assembly and a back-mounting link coupled to a seat-mounting plate, a base plate coupled to a lift-base assembly via a lift assembly, a drive bracket, a motor tube, and two linear actuators for automating adjustment of the linkage mechanism. In operation, a first phase involves a second linear actuator rotating the motor tube, thereby causing the seat-adjustment assembly to bias the seat-mounting plate. A second phase involves a first linear actuator rotating the drive bracket, thereby causing the footrest assembly to extend or retract without affecting the bias of the back-mounting link. A third phase involves the first linear actuator causing the lift assembly to raise and tilt the base plate directly over the lift-base assembly.

19 Claims, 10 Drawing Sheets

(56) References Cited

U.S. PATENT DOCUMENTS

| | | | | |
|---|---|---|---|---|
| 5,219,204 | A | 6/1993 | Bathrick et al. | |
| 5,265,935 | A | 11/1993 | Geisler et al. | |
| 5,312,153 | A | 5/1994 | Lin | |
| 5,466,046 | A | 11/1995 | Komorowski et al. | |
| 5,482,350 | A | 1/1996 | Komorowski et al. | |
| 5,651,580 | A * | 7/1997 | LaPointe et al. | 297/85 M |
| 5,730,494 | A | 3/1998 | LaPointe et al. | |
| 5,772,278 | A | 6/1998 | Kowalski | |
| 5,975,627 | A | 11/1999 | LaPointe et al. | |
| 5,992,930 | A | 11/1999 | LaPointe et al. | |
| 6,000,758 | A | 12/1999 | Schaffner et al. | |
| 6,659,556 | B2 | 12/2003 | Pellerin et al. | |
| 6,729,686 | B2 | 5/2004 | May | |
| 6,840,575 | B2 | 1/2005 | Hesse | |
| 6,871,910 | B2 | 3/2005 | Hale | |
| 7,497,512 | B2 | 3/2009 | White et al. | |
| 7,543,885 | B2 * | 6/2009 | Pollard et al. | 297/85 R |
| 7,575,279 | B2 | 8/2009 | Robertson | |
| 7,585,018 | B2 | 9/2009 | LaPointe et al. | |
| 7,631,937 | B2 | 12/2009 | Robertson | |
| 7,673,933 | B2 * | 3/2010 | Lawson | 297/69 |
| 7,766,421 | B2 | 8/2010 | Lawson | |
| 8,016,348 | B2 | 9/2011 | Hoffman et al. | |
| 8,308,228 | B2 | 11/2012 | Lawson et al. | |
| 8,398,165 | B2 | 3/2013 | Lawson | |
| 8,398,171 | B2 | 3/2013 | Lin et al. | |
| 8,419,122 | B2 | 4/2013 | Lawson et al. | |
| 8,573,687 | B2 | 11/2013 | Lawson et al. | |
| 2001/0035668 | A1 | 11/2001 | Gaffney et al. | |
| 2002/0149238 | A1 | 10/2002 | Hoffman et al. | |
| 2003/0015893 | A1 | 1/2003 | Hoffman | |
| 2003/0047973 | A1 | 3/2003 | Pellerin | |
| 2003/0057743 | A1 | 3/2003 | May | |
| 2006/0238007 | A1 | 10/2006 | Lin | |
| 2007/0257525 | A1 | 11/2007 | Wiecek | |
| 2008/0001442 | A1 | 1/2008 | Wiecek | |
| 2008/0111402 | A1 | 5/2008 | Crum | |
| 2008/0150329 | A1 * | 6/2008 | Lawson | 297/84 |
| 2011/0193373 | A1 | 8/2011 | Lawson et al. | |
| 2011/0304193 | A1 | 12/2011 | Murphy et al. | |
| 2012/0235449 | A1 | 9/2012 | Wiecek | |
| 2012/0299363 | A1 | 11/2012 | Crum | |

OTHER PUBLICATIONS

Non-Final Office Action in U.S. Appl. No. 12/981,185 mailed Feb. 27, 2012, 11 pages.

International Searching Authority, Patent Cooperation Treaty Search, International Application No. PCT/US2011/024211 mailed on Apr. 6, 2011, 13 pages.

ISR mailed Mar. 1, 2013, in related case U.S. Appl. No. 13/344,215, filed Jan. 5, 2012, 14 pages.

ISR mailed Mar. 1, 2013, in U.S. Appl. No. 13/344,330, filed Jan. 5, 2012, 15 pages.

Notice of Allowance in U.S. Appl. No. 13/344,215, mailed Sep. 19, 2013, 15 pages.

International Search Report and Written Opinion for PCT/US2013/051065, mailed Dec. 23, 2013, 18 pages.

Supplemental European Search Report, mailed Feb. 5, 2014.

Non Final Office Action in U.S. Appl. No. 13/551,897, mailed Mar. 12, 2014, 33 pages.

* cited by examiner

LINKAGE MECHANISM FOR A DUAL-MOTOR LIFTING RECLINER

BACKGROUND OF THE INVENTION

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "seating units." More particularly, the present invention relates to an improved linkage mechanism developed to accommodate a wide variety of styling for a seating unit, which is otherwise limited by the configurations of linkage mechanisms in the field. Additionally, the improved linkage mechanism of the present invention provides for reclining a seating unit that is positioned against a wall or placed within close proximity of other fixed objects.

Reclining and lifting seating units exist that allow a user to forwardly extend a footrest, to recline a backrest rearward relative to a seat, and to lift the seat for accommodating easy ingress and egress thereof. These existing seating units typically provide three basic positions (e.g., a standard, nonreclined closed position; an extended position; and a reclined position), and a seat-lift position as well. In the closed position, the seat resides in a generally horizontal orientation and the backrest is disposed substantially upright. Additionally, if the seating unit includes an ottoman attached with a mechanical arrangement, the mechanical arrangement is collapsed such that the ottoman is not extended. In the extended position, often referred to as a television ("TV") position, the ottoman is extended forward of the seat, and the backrest remains sufficiently upright to permit comfortable television viewing by an occupant of the seating unit. In the reclined position the backrest is pivoted rearward from the extended position into an obtuse relationship with the seat for lounging or sleeping. In the seat-lift position, the recliner mechanism is typically adjusted to the closed position and a lift assembly raises and tilts forward the seating unit in order to facilitate entry thereto and exit therefrom.

Several modern seating units in the industry are adapted to provide the adjustment capability described above. However, these seating units require relatively complex linkage mechanisms to afford this capability. The complex linkage assemblies limit certain design aspects when incorporating automation. In particular, the geometry of these linkage assemblies impose constraints on incorporating or mounting a plurality of motors thereto. Such constraints include the motors, during extension and/or retraction when adjusting between the positions mentioned above, interfering with crossbeams, the underlying surface, or moving parts attached to the linkage assembly. In view of the above, a more refined linkage mechanism that achieves full movement when being automatically adjusted between the closed, extended, reclined, and even seat-lift positions would fill a void in the current field of motion-upholstery technology. Accordingly, embodiments of the present invention pertain to a novel linkage mechanism that is constructed in a simple and refined arrangement in order to provide suitable function while overcoming the above-described, undesirable features inherent within the conventional complex linkage mechanisms.

BRIEF SUMMARY OF THE INVENTION

Embodiments of the present invention seek to provide a simplified lifter-recliner linkage mechanism that can be assembled to a pair of compact motors and that can be adapted to essentially any style of seating unit. In an exemplary embodiment, the compact motors in concert with the linkage mechanism can achieve full movement and sequenced adjustment of the seating unit when being automatically adjusted between the closed, extended, reclined, and seat-lift positions. The compact motors may be employed in a proficient and cost-effective manner to adjust the linkage mechanism without creating interference or other disadvantages appearing in the conventional designs that are inherent with automation thereof. The linkage mechanism may be configured with features (e.g., logic that controls the compact motors individually) that assist in sequencing the seating-unit adjustment between positions, maintaining a seat in a substantially consistent location during the seating-unit adjustment, and curing other disadvantages appearing in the conventional designs.

Generally, the lifter-recliner seating unit includes the following components: foot-support ottoman(s); a pair of base plates in substantially parallel-spaced relation; a pair of lift assemblies and at least one crossbeam spanning the lift assemblies; a lift-base assembly coupled to the lift assemblies via the lift assemblies; a pair of seat-mounting plates in substantially parallel-spaced relation; and a pair of the generally minor-image linkage mechanisms that interconnect the base plates to the seat-mounting plates. In operation, the linkage mechanisms are adapted to move between a seat-lift position, a closed position, an extended position, and a reclined position, while the lift assemblies are adapted to move the linkage mechanisms into and out of a seat-lift position.

In one embodiment, the linkage mechanisms include a footrest assembly that extends and retracts at least one foot-support ottoman and a seat-adjustment assembly that reclines and inclines the backrest. Further, the lifter-recliner seating unit may include a first linear actuator that provides automated adjustment of the seating unit between the closed position, the extended position, and the seat-lift position. Typically, the first linear actuator is configured to move the lift assemblies into and out of the seat-lift position while maintaining the linkage mechanisms in the closed position and while consistently maintaining the seat-mounting plates inside a footprint of the lift-base assembly. The lifter-recliner seating may also include a second linear actuator that provides automated adjustment of the seating unit between the extended position and the reclined position.

In yet another embodiment, the seating unit includes the first linear actuator and the second linear actuator. The first linear actuator that provides automated adjustment of the linkage mechanisms between the closed position, the extended position, and the seat-lift position, while the second linear actuator that provides automated adjustment of the seating unit between the extended position and the reclined position. Generally, the first-linear-actuator adjustment is sequenced into a second phase and a third phase. In one instance, the second phase moves the footrest assembly between the extended position and the closed position. In another instance, the third phase moves the pair of lift assemblies into and out of the seat-lift position while maintaining the pair of linkage mechanisms in the closed position.

The second linear actuator generally provides automated adjustment of the seating unit between the extended position and the reclined position. In embodiments, the second-linear-actuator adjustment involves a first phase that is sequenced with the second phase and the third phase such that the first, second, and third phases are mutually exclusive in stroke. In operation, the first phase moves the seat-adjustment assembly between the reclined position and the extended position.

In an exemplary embodiment, each of the linkage mechanisms includes a footrest drive link and a footrest drive bracket. The footrest drive bracket is fixedly attached to one of the ends of an activator shaft. The footrest drive link that includes a front end and a back end, where the footrest drive bracket is pivotably coupled to the back end of the footrest drive link and the front end of the footrest drive link is pivotably coupled to the footrest assembly. Typically, the activator shaft spans between and couples to the linkage mechanisms. In one instance, the activator shaft is configured with a pair of ends, where one of the ends of the activator shaft is rotatably coupled to a respective base plate via an activator mounting plate.

Generally, the first linear actuator includes the following components: a first motor mechanism; a track operably coupled to the first motor mechanism; and a motor activator block that translates longitudinally along the track under automated control. In instances, the track includes a second travel section and a third travel section. Further, the second linear actuator includes the following components: a second motor mechanism; and an extendable element that includes a first travel section, where the extendable element extends and retracts over the first travel section with respect to the second motor mechanism.

In operation, adjustment of the seating unit is sequenced into a first phase, a second phase, and a third phase that are mutually exclusive in stroke. During the first phase, the second linear actuator moves the seat-adjustment assembly between the reclined position and the extended position when the extendable element of the second linear actuator is repositioned over the first travel section. In an exemplary embodiment, moving the seat-adjustment assembly between the reclined position and the extended position involves the second linear actuator rotating a rear bellcrank over a first angular increment, where the rear bellcrank is pivotably coupled to a backrest via intervening elements.

During the second phase, the motor activator block longitudinally translates along the second travel section, thereby causing the activator shaft to rotate and, consequently, causes the footrest drive bracket to rotate over a second angular increment of rotation. This second angular increment of rotation translates the footrest drive link rearward, generating a lateral pull against the footrest assembly that invokes the footrest assembly to adjust from the extended position and the closed position. Typically, the first angular increment includes an angular rotation that does not overlap an angular rotation of the second angular increment.

During the third phase, the motor activator block longitudinally translates along the third travel section, thereby creating a lateral thrust at the activator shaft. Because, at this point, the activator shaft is prevented from further rotation as a result of a detent condition of the linkage mechanism in the closed position (e.g., the footrest drive bracket contacting an upper surface of the base plate), this longitudinal translation within the third travel section invokes adjustment of the lift assemblies into or out of the seat-lift position, while maintaining the linkage mechanisms in the closed position. This adjustment to the seat-lift position causes the seat-mounting plate to ascend and tilt with respect to the lift-base assembly while, at the same time, remain within the lift-base assembly's footprint on an underlying surface. As such, embodiments of the present invention introduce a pair of linear actuators that are configured to cooperatively and controllably adjust the linkage mechanisms of a seating between the four positions above in a sequential or continuous manner.

Further, as mentioned above, the seat-adjustment assembly is enabled to recline and incline the backrest. In embodiments, the seat-adjustment assembly includes the rear bellcrank, a back-mounting link, and a back-support link. The rear bellcrank that is pivotably coupled directly or indirectly to the rearward portion of the base plate. Also, the rear bellcrank is pivotably couple, via intervening links, to the extendable element of the second linear actuator. For instance, a second motor tube may be provided that is fixedly attached directly or indirectly to the rear bellcrank, where the second motor tube extends substantially perpendicular to the rear bellcrank in an inward manner to reside below the seat. The back-mounting link may be pivotably coupled directly or indirectly to the rearward portion of the seat-mounting plate. And, the back-support link may include has an upper end and a lower end, where the upper end of the back-support link is pivotably coupled to the back-mounting link while the lower end of the back-support link is pivotably coupled to the rear bellcrank.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
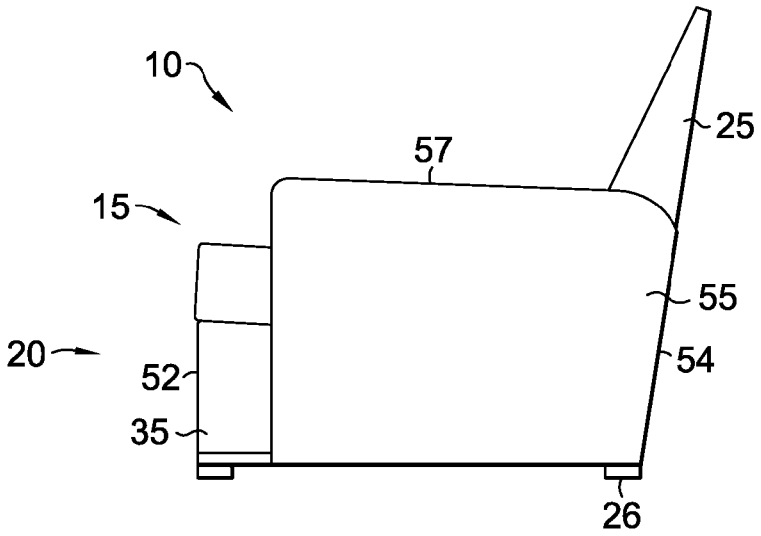
FIG. 1 is a diagrammatic lateral view of a seating unit in a closed position, in accordance with an embodiment of the present invention.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies.

Generally, embodiments of this invention introduce technology within the motion furniture industry to improve operation and styling of a lifter-recliner-type seating unit. In embodiments, the operational improvements include: configuring linkage mechanisms of the seating unit to maintain a seat and backrest directly above the lift assembly throughout adjustment; designing the linkage mechanisms to attach to a lift-base assembly via one attachment point per side; and employing a straight tube to serve as a majority of the base plate, thereby minimizing weight and material. In embodiments, the styling improvements include: attaching lift links of the lift assembly directly to the linkage mechanisms, respectively, in order to increase stability of the seating unit; and reorganizing attachment points interconnecting links comprising the linkage mechanisms, thereby allowing for such styling features as T-cushion seating. These above-listed improvements, as well as various others, will become evident within the description below and the accompanying drawings.

Further, the linkage mechanisms of the seating unit disclosed herein provide innovations that include a unique configuration that allows for a common lift motor to be used for both a dual-motor design and a dual-motor design of the lifting recliner; thus, allowing chair manufacturers to purchase fewer versions of the linkage mechanism to support various motorized options. For example, cross tubes (see reference numerals 375 and 650 of FIG. 6) and an activator shaft (see reference numeral 350 of FIG. 5) that are employed by the dual-motor design may also be used in the dual-motor design. This dual-motor design involves only two additional cross tubes for supporting the second linear actuator and a simple modification to the number and attachment locations of the articulating links that inter-couple the base plate 410 (see FIG. 7) and the seat-mounting plate 400 (see FIG. 7) of the linkage mechanisms. Thus, chair manufacturers potentially realize significant savings by reducing inventory of the linkage mechanisms via the use of interchangeable components. That is, a common group of links and tubes that serve as the base linkage mechanisms for assembling a complete lifting recliner with either the single- or dual-motor design ostensibly minimizes inventory by half.

FIGS. 1-4 illustrate a seating unit 10. Seating unit 10 has a seat 15, a backrest 25, legs 26 (e.g., floor-support bushings or a lift-base assembly 600 that rests upon an underlying surface), at least one linkage mechanism 100, at least one lift assembly 700, a first motor assembly 300, a second motor assembly (see reference numeral 370 of FIG. 6) at least one foot-support ottoman 45, a stationary base 35 or chassis, and a pair of opposed arms 55. Stationary base 35 has a forward section 52, a rearward section 54, and is supported by the legs 26 or the lift-base assembly 600 (see FIG. 5), which vertically suspends the stationary base 35 above the underlying surface (not shown). In addition, the stationary base 35 is interconnected to the seat 15 via the linkage mechanism(s) 100 that are generally disposed between the pair of opposed arms 55 and the rearward section 54. Seat 15 remains generally fixed in location over the stationary base 35 during adjustment of the seating unit 10, or when raising or lowering the seating unit 10 into or out of a seat-lift position (see FIG. 6). In embodiments, the seat 15 and/or the backrest 25 is moveable according to the arrangement of the linkage mechanism 100 such that interference between the seat 15/backrest 25 and the opposed arms 55 is prevented throughout adjustment.

Opposed arms 55 are laterally spaced and have an arm-support surface 57 that is typically substantially horizontal. In one embodiment, the pair of opposed arms 55 are attached to the stationary base 35 via intervening members. The backrest 25 extends from the rearward section 54 of the stationary base 35 and is rotatably coupled to the linkage mechanism(s) 100, typically proximate to the arm-support surface 57. Foot-support ottoman(s) 45 are moveably supported by the linkage mechanism(s) 100. The linkage mechanism(s) 100 are arranged to articulately actuate and control movement of the seat 15, the back 25, and the ottoman(s) 45 between the positions shown in FIGS. 1-3, as more fully described below. In addition, when the linkage mechanism 100 is adjusted to the closed position (see FIG. 3), the lift assembly 700 is configured to adjust the seating unit 10 into and out of the seat-lift position (see FIG. 4).

As shown in FIGS. 1-4, the seating unit 10 is adjustable to four positions: a closed position 20, an extended position 30 (i.e., TV position), the reclined position 40, and the seat-lift position 50. FIG. 1 depicts the seating unit 10 adjusted to the closed position 20, which is a normal nonreclined sitting position with the seat 15 in a generally horizontal position and the backrest 25 generally upright and generally perpendicular to the seat 15. In one embodiment, the seat 15 is disposed in a slightly inclined orientation relative to the stationary base 35. In this embodiment, the inclined orientation may be maintained throughout adjustment of the seating unit 10 due to the novel configuration of the linkage mechanism(s) 100. Further, when adjusted to the closed position 20, the foot-support ottoman(s) 45 are positioned below the seat 15.

Figure 2:
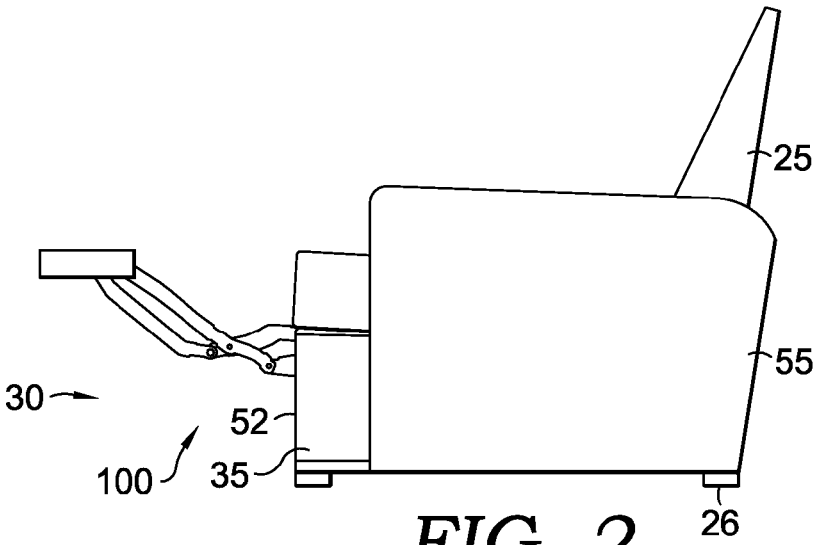
FIG. 2 is a view similar to FIG. 1, but in an extended position, in accordance with an embodiment of the present invention.

Turning to FIG. 2, the extended position 30, or TV position, will now be described. When the seating unit 10 is adjusted to the extended position 30, the foot-support ottoman(s) 45 are extended forward of the forward section 52 of the stationary base 35 and disposed in a generally horizontal orientation. However, the backrest 25 remains substantially perpendicular to the seat 15 and will not encroach an adjacent wall. Also, the seat 15 is maintained in the inclined orientation relative to the stationary base 35. Typically, the seat 15 is not translated forward, backward, downward, or upward relative to the stationary base 35. Thus, the configuration of the seating unit 10 in the extended position 30 provides an occupant an inclined TV position while providing space-saving utility. This lack of independent movement of the seat 15, with respect to the opposed arms 55, allows for a variety of styling to be incorporated into the seat 15, such as T-cushion styling.

Figure 3:
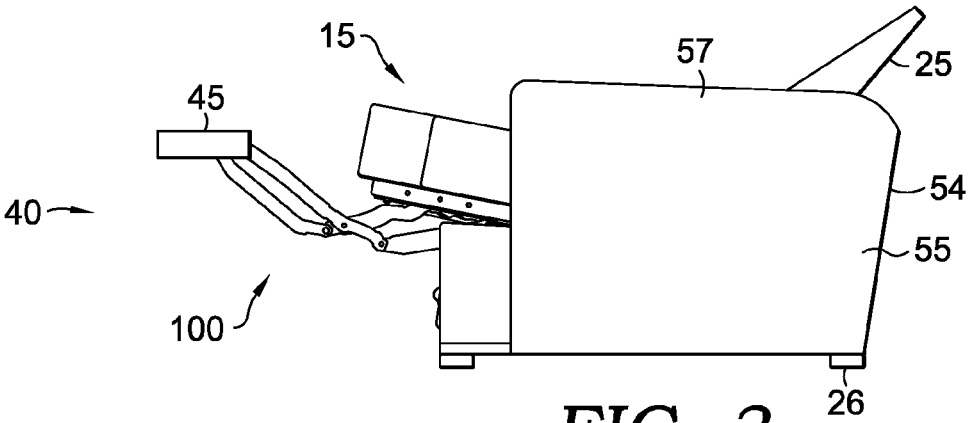
FIG. 3 is a view similar to FIG. 1, but in a reclined position, in accordance with an embodiment of the present invention.

FIG. 3 depicts the reclined position 40, in which the seating unit 10 is fully reclined. Typically, the backrest 25 is rotated rearward by the linkage mechanism 100 and biased in a rearward inclination angle. The rearward inclination angle is typically an obtuse angle in relation to the seat 15. However, the rearward inclination angle of the backrest 25 is offset by a slight-to-negligible forward and upward translation of the seat 15 as controlled by the linkage mechanism 100. This is in contrast to other reclining chairs with 3- or 4-position mechanisms, which cause their backrest to move rearward during adjustment, thereby requiring that the reclining chair be positioned a considerable distance from an adjacent rear wall or other proximate fixed objects. Thus, the general lack of translation of the seat 15 in embodiments of the present invention allows for zero-wall clearance. Generally, the "zero-wall clearance" is utilized herein to refer to a space-saving utility that permits positioning the seating unit 10 in close proximity to an adjacent rear wall and other fixed objects behind the seating unit. In embodiments of the reclined position 40, the foot-support ottoman(s) 45 may be moved slightly upward, but not translated forward or rearward, from their position in the extended position 30.

Figure 4:
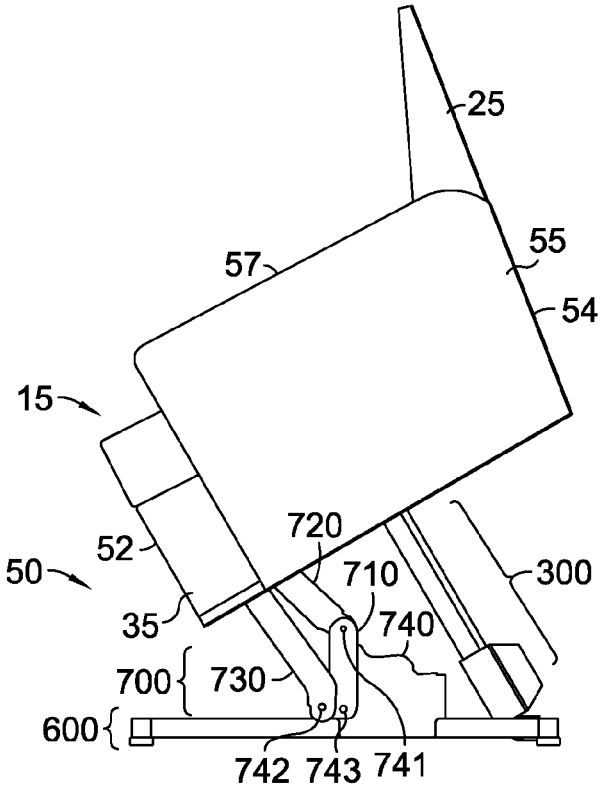
FIG. 4 is a view similar to FIG. 1, but in a seat-lift position, in accordance with an embodiment of the present invention.

Turning to FIG. 4, the seat-lift position 50, will now be described. When the seating unit 10 is adjusted to the seat-lift position 50, the linkage mechanism(s) 100 are maintained in the closed position 20 of FIG. 1, but raised upward and tilted forward to assist with an occupant's ingress to and egress from the seating unit 10. In an exemplary embodiment, the lift assemblies 700 are employed to raise and tilt the linkage mechanism(s) 100, as well as the seating-unit components attached thereto, with respect to the lift-base assembly 600. In one instance, adjustment of the lift assembly 700 may be automated through the use of a first linear actuator within the first motor assembly 300. Typically, selective cooperation of the first linear actuator and a second linear actuator within the second motor assembly 370 are employed to adjust the linkage mechanism 100 between the closed, extended, and reclined positions as well.

In embodiments, lift links 720 and 730 of the lift assembly 700 are pivotably coupled to a riser connector plate 710 at connection points 741 and 742, respectively. The pivotable coupling of the lift links 720 and 730 at the connection points 741 and 742 may be made via rivets, which greatly reduce material cost, assembly labor time, and allow for a much greater separation of the left- and right-side lift links. This widened separation between the lift links 720 and 730 and the opposed lift links (not shown) substantially increases the stability of the seating unit 10.

Further, the links 710, 720, and 730 of the lift assembly 700 may be initially incorporated within the linkage mechanism 100, while the lift-base assembly 600 is initially assembled separately. In embodiments, the linkage mechanism 100 is mounted to the lift-base assembly 600 at connection point 743, which fixedly attaches the riser connector plate 710 of the lift assembly to a lift bracket 740 that is typically welded to the lift-base assembly 600. In this way, the connection point 743 allows for linkage mechanism 100 to be attached to the lift-base assembly 600 with only one fastener (e.g., shoulder bolt). Thus, the assembly process of attaching the linkage mechanism 100 to the lift-base assembly 600 is simplified and can be easily performed prior to shipping on the fabrication facility or subsequent to shipping on the premise of a seating-unit manufacturer. By attaching the linkage mechanism 100 to the lift-base assembly 600 after shipping, the freight costs are reduced as the components may be packaged individually in order to minimize cargo space being utilized.

As can be seen, the lack of translation of the seat 15 during the adjustment between the closed position 20, extended position 30, reclined position 40, and the seat-lift position 50, enables the seat 15 to remain substantially in place directly over lift-base assembly 600. This lack of translation is caused by the geometry of the linkage mechanism 100. This geometry accommodates an innovative dual-motor design (see FIGS. 5 and 6) that allows the seating unit 10 to remain positioned directly over a perimeter of the lift-base assembly 600 (e.g., hovering over a profile established by the adjoining structural elements that form a foundation of the seating unit) through each adjustment of the seating unit 10. Specifically, as will be demonstrated later via FIGS. 7-10, the linkage mechanism 100 prevents the seat 15 from shifting rearward as the footrest assembly 200 extends. Instead, upon adjusting from the closed position 20 to the extended position 30, the seat 15 moves generally upward and slightly forward, thereby acting to recline the seating unit 10. In this way, the lifting of the seat 15 helps to balance the reclining movement of a seating-unit occupant's weight.

Moreover, this consistent lateral positioning (i.e., insignificant fore or aft movement of the seat) provides furniture manufacturers the ability to offer a full enclosure of both the linkage mechanism 100 and the lift-base assembly 600, thereby providing full protection of articulating linkages when the seating unit 10 is adjusted to the seat-lift position 50. In contrast, conventional dual-motor designs translate the seat forward or rearward during adjustment such that the seat 15 moves outside a perimeter of the lift-base assembly 600. In particular examples, these conventional designs either move their seat rearward when reclining (e.g., push-on-the-arm style chairs) or move their seat forward (e.g., traditional wall-avoiding style chairs).

Turning to FIGS. 5-10, exemplary configurations of a linkage mechanism 100 for a lifter-recliner-type seating unit 10 (hereinafter "seating unit") that is powered by two linear actuators included within the first motor assembly 300 and the second motor assembly 370, respectively, are illustrated and will now be discussed. With initial reference to FIG. 5, a perspective view of the linkage mechanism 100 in the reclined position is shown, in accordance with an embodiment of the present invention. In embodiments, the linkage mechanism 100 includes a footrest assembly 200, a seat-mounting plate 400, a base plate 410, a seat-adjustment assembly 500, the lift-base assembly 600, and the lift assembly 700. The footrest assembly 200 is comprised of a plurality of links arranged to extend and collapse the ottoman(s) (e.g., foot-support ottoman 45 of FIGS. 1-4) during adjustment of the seating unit between the extended position and the closed position, respectively. The seat-mounting plate 400 is configured to fixedly mount to the seat of the seating unit and, in conjunction with an opposed seat-mounting plate, defines a seat support surface (not shown). Generally, the seat-adjustment assembly 500 is adapted to recline and incline the backrest of the seating unit, which is coupled to a back-mounting link 510 of the seat-adjustment assembly 500. Further, the seat-adjustment assembly 500 includes links (e.g., activator mounting plate 360 and rear bellcrank 460) that indirectly couple the pair of linear actuators to the base plate 410 and back-mounting link, respectively, thereby facilitating lifting movement of the seat and backrest upon selective actuation of the first and second linear actuators.

Further, the linkage mechanism 100 comprises a plurality of linkages that are arranged to actuate and control movement of the seating unit during adjustment between the closed, the extended, the reclined, and the seat-lift position. These linkages may be pivotably interconnected. It is understood and appreciated that the pivotable couplings (illustrated as pivot points in the figures) between these linkages can take a variety of configurations, such as pivot pins, bearings, traditional mounting hardware, rivets, bolt and nut combinations, or any other suitable fasteners which are well known in the furniture-manufacturing industry.

In a particular example, the articulating joints (e.g., rotatable and pivotable couplings) are incorporated within the linkage mechanism 100 (e.g., rivets), with the possible exception of the rotational interface between the activator shaft 350 and the activator mounting plate 360. This feature of providing the articulating joints within the linkage mechanism 100 minimizes repair costs associated with wear, as the more expensive welded assemblies (e.g., lift-base assembly 600) will not be exposed to wear. Although the rotational interface between the activator shaft 350 and the activator mounting plate 360 (including welded joints) is subject to wear, the assembly of the activator shaft 350, the activator mounting plate 360, and other fixedly attached components is easily replaced without disassembling any other portions of the linkage mechanism 100 or lift-base assembly 600. Generally, in nonmoving connections (e.g., connection point 743 of FIG. 4), most other fasteners are standard bolts.

Also, the shapes of the linkages and the brackets may vary as desired, as may the locations of certain pivot points. It will be understood that when a linkage is referred to as being pivotably "coupled" to, "interconnected" with, "attached" on, etc., another element (e.g., linkage, bracket, frame, and the like), it is contemplated that the linkage and elements may be in direct contact with each other, or other elements (such as intervening elements) may also be present.

Generally, the linkage mechanism 100 guides the rotational movement of the backrest, the minimal (if any) translation of the seat, and the extension of the ottoman(s). In an exemplary configuration, these movements are controlled by a pair of essentially mirror-image linkage mechanisms (one of which is shown herein and indicated by reference numeral 100), which comprise an arrangement of pivotably interconnected linkages. The linkage mechanisms are typically disposed in opposing-facing relation about a longitudinally-extending plane that bisects the seating unit between the pair of opposed arms. As such, the ensuing discussion will focus on only one of the linkage mechanisms 100, with the content being equally applied to the other, complimentary, linkage assembly.

With continued reference to FIG. 5, the lift-base assembly 600 will now be discussed. Typically, the lift-base assembly 600 serves as a foundation that rests on a surface underlying the seating unit. The lift-base assembly 600 includes a front lateral member 610, a rear lateral member 620, a right longitudinal member 630, and a left longitudinal member (not shown). These members 610, 620, 630 may be formed from square metal tubing, or any other material used in the furniture-manufacturing industry that exhibits rigid properties. The front lateral member 610 and the rear lateral member 620 serve as crossbeams that span between and couple together the right longitudinal member 630 and the left longitudinal member. Generally, the rear lateral member 620 is oriented in substantially parallel-spaced relation to the front lateral member 610. Also, the right longitudinal member 630 is oriented in substantially parallel-spaced relation to the left longitudinal member, where the left and right longitudinal members 630 span and couple the front and rear lateral members 610 and 620. Further, the front lateral member 610 and the rear lateral member 620 are fixedly attached (e.g., welded or fastened at connection points 744 and 745) to a pair of lift brackets 740 (see FIG. 10), respectively, within the lift assemblies 700. As such, the lift-base assembly 600 extends between and fixedly attaches the lift assemblies 700 in a parallel-spaced manner.

When constructed into the lift-base assembly 600, the members 610 and 620 reside in substantial perpendicular relation with the right longitudinal member 630 and opposed left longitudinal member. In its role as a foundation, the lift-base assembly 600 acts as a platform by which the lift assembly 700 may raise and tilt the seating unit with respect to the underlying surface. Further, as more fully discussed below, the first linear actuator of the first motor assembly 300 controls movement of the lift assembly 700 and is pivotably coupled to the rear lateral member 620 of the lift-base assembly 600. Even further, the left and right longitudinal members 630 and the front and rear lateral members 610 and 620 represent a perimeter or profile of a footprint of the lift-base assembly 600. During adjustment of linkage mechanism 100, the seat is consistently maintained directly over the footprint of the lift-base assembly 600, thereby reaping those benefits (e.g., enabling complete fabric coverage of the lift assembly 700 and enhancing balance of the weight of an occupant within the seating unit) more fully discussed above. In other words, the first linear actuator—providing automated adjustment of the seating unit between the closed position, the extended position, and the seat-lift position—is configured to move the lift assembly 700 into and out of the seat-lift position while maintaining the linkage mechanisms 100 in the closed position and while consistently maintaining the seat-mounting plates 400 inside a footprint of the lift-base assembly 600.

Figure 5:
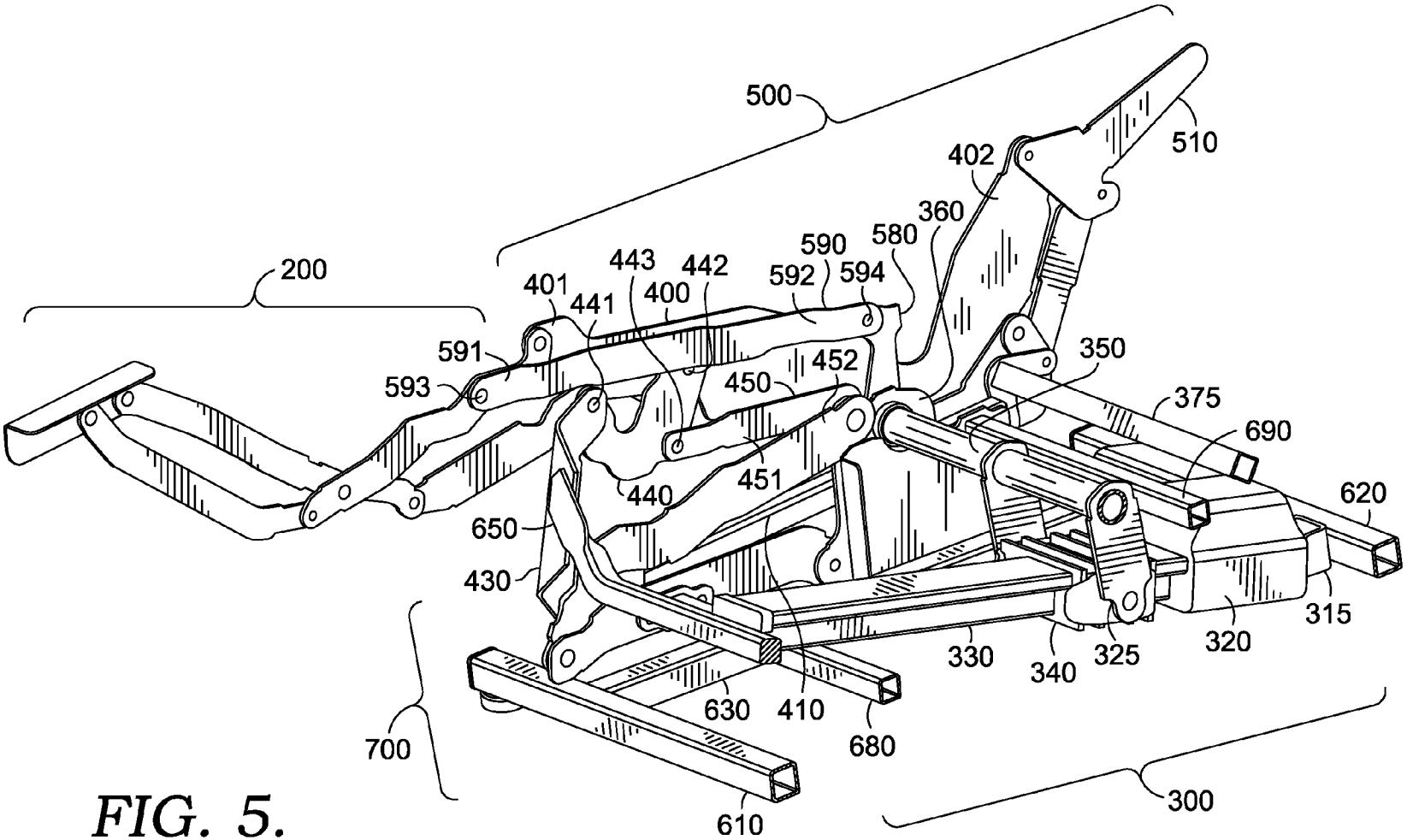
FIG. 5 is a perspective view of a linkage mechanism in the reclined position illustrating a first linear actuator for providing motorized adjustment of the seating unit, in accordance with an embodiment of the present invention.
Figure 7:
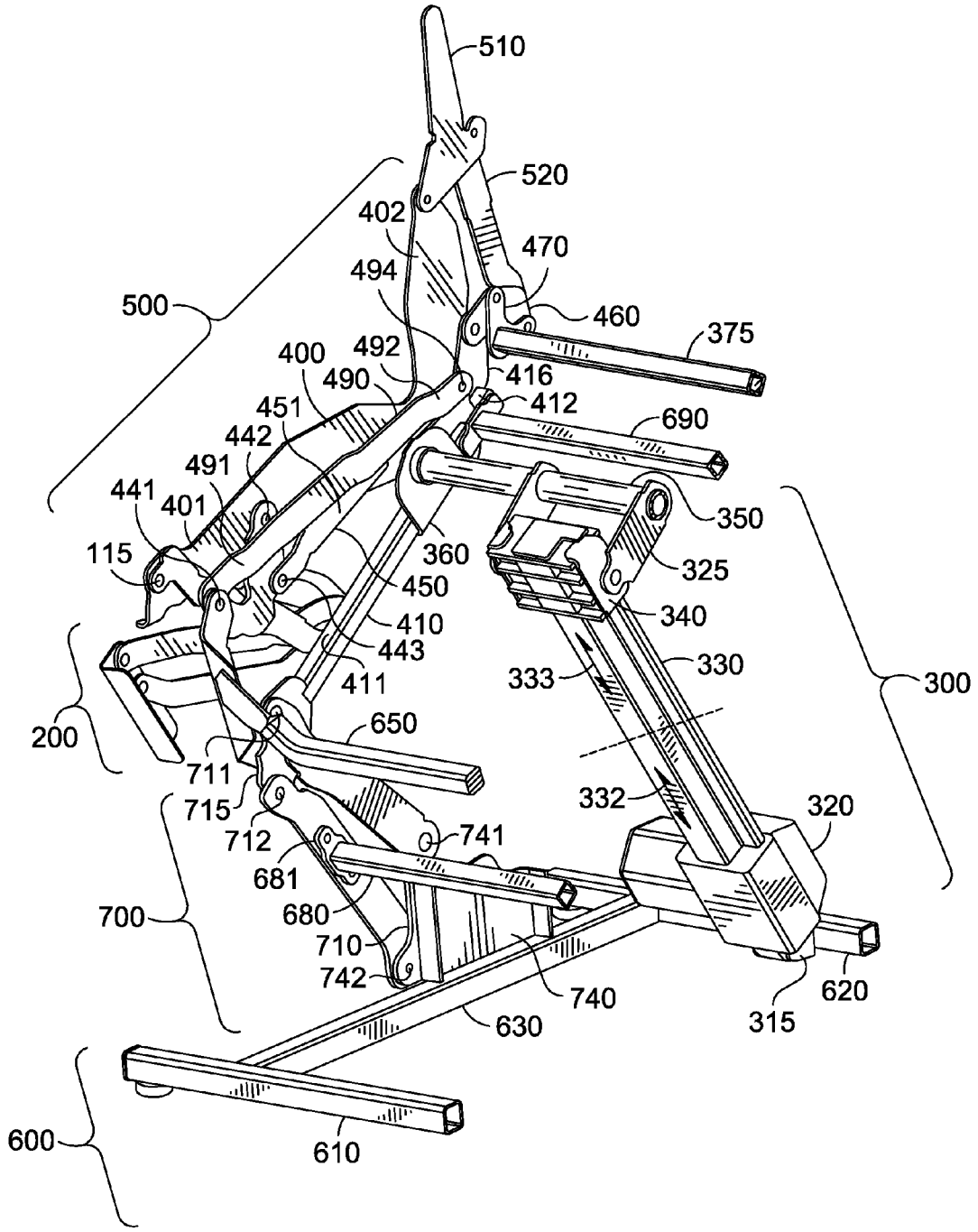
FIG. 7 is a view similar to FIG. 5, but in the seat-lift position, in accordance with an embodiment of the present invention.

Referring to FIGS. 5 and 7, an automated version of the seating unit, which utilizes a dual-motor linear actuator, is illustrated and will now be discussed via the embodiments below. In an exemplary embodiment, the linkage mechanism 100 and the lift-base assembly 600 (discussed immediately above) are inter-coupled using the first linear actuator of the first motor assembly 300, which provides powered adjustment of the linkage mechanism 100 between the extended and the closed positions. Further, the first linear actuator is employed to provide powered adjustment of the lift assemblies 700 into and out of the seat-lift position, while holding the linkage mechanism in the closed position. The first motor assembly 300 includes a rear motor bracket 315, a first motor mechanism 320, a front motor bracket 325, a track 330, a motor activator block 340, an activator shaft 350, and an activator mounting plate 360. Typically, the first motor mechanism 320 and the motor activator block 340 are slidably connected to each other via the track 330, while the first motor mechanism 320 and the motor activator block 340 are held in position by and pivotably coupled to the rear lateral member 620 of the lift-base assembly 600 and the base plate 410 of the linkage mechanism 100, respectively. For example, as illustrated in FIG. 5, the motor activator block 340 may be pivotably coupled to a section between a pair of ends of the rear lateral member 620 via the rear motor bracket 315.

In an exemplary configuration, the first motor mechanism 320 is protected by a housing that is pivotably coupled to the rear lateral member 620 of the lift-base assembly 600 via the rear motor bracket 315. The motor activator block 340 may be pivotably coupled to the front motor bracket 325 by way of rotational components (e.g., bearings). The front motor bracket 325 may be fixedly attached to a mid section of the activator shaft 350. The activator shaft 350 generally spans between and couples to the linkage mechanism 100 and the opposed, counterpart, mirror-image linkage mechanism (not shown). Also, the activator shaft 350 includes a pair of ends, where each of the ends of the activator shaft 350 is rotatably coupled to a respective base plate via a rotatable interface at an activator mounting plate. For instance, one of the ends of the activator shaft 350 may rotatably couple with the base plate 410 via a rotatable interface at the activator mounting plate 360, where the rotatable interface may comprise at least one of bearings, interlocking bushings, or any other device known in the furniture-fabrication industry that enables one component to pivot with respect to another component.

Figure 6:
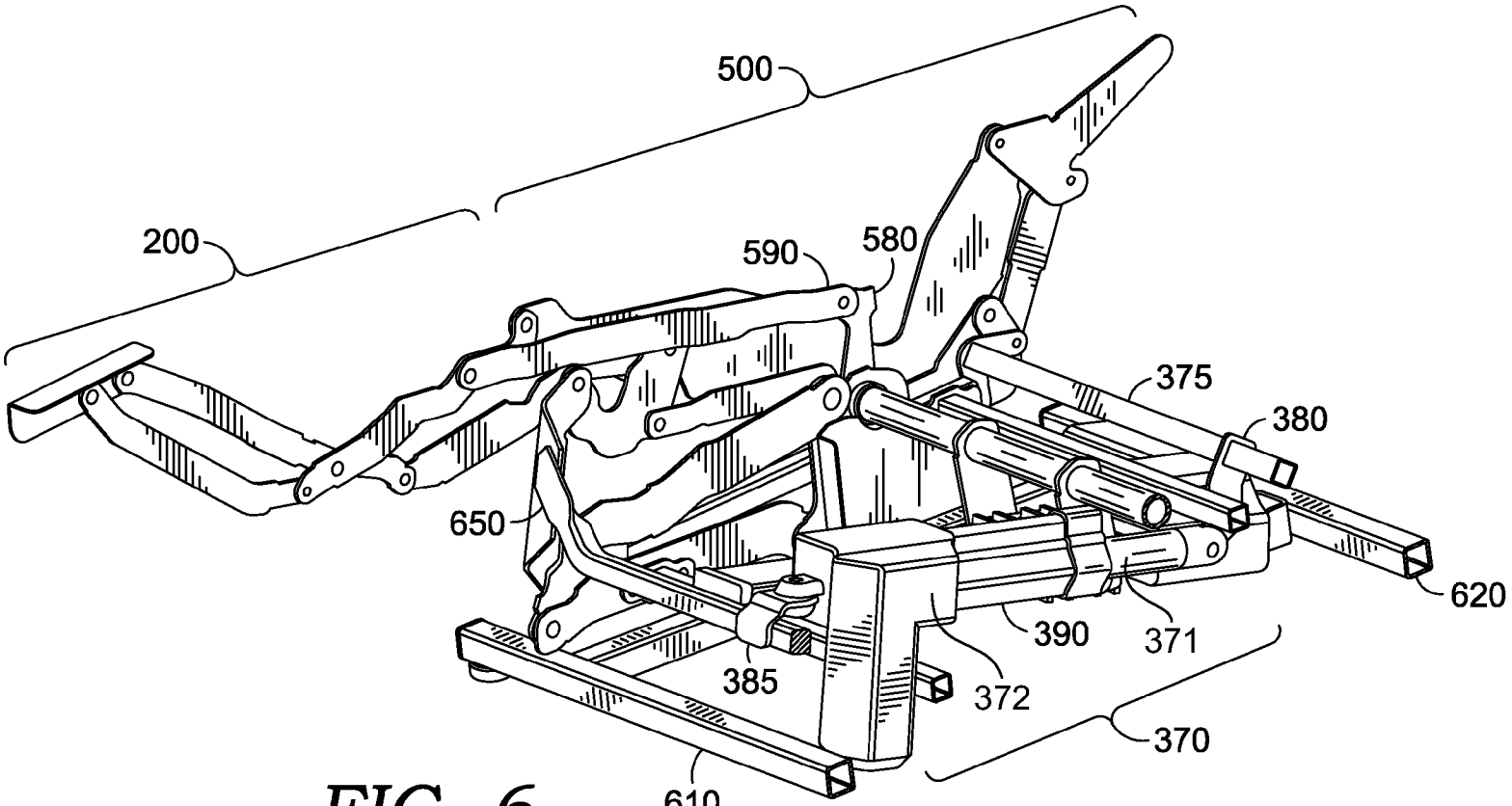
FIG. 6 is a view similar to FIG. 5, but illustrating the first and a second linear actuator for providing motorized adjustment of the seating unit, in accordance with an embodiment of the present invention.
Figure 8:
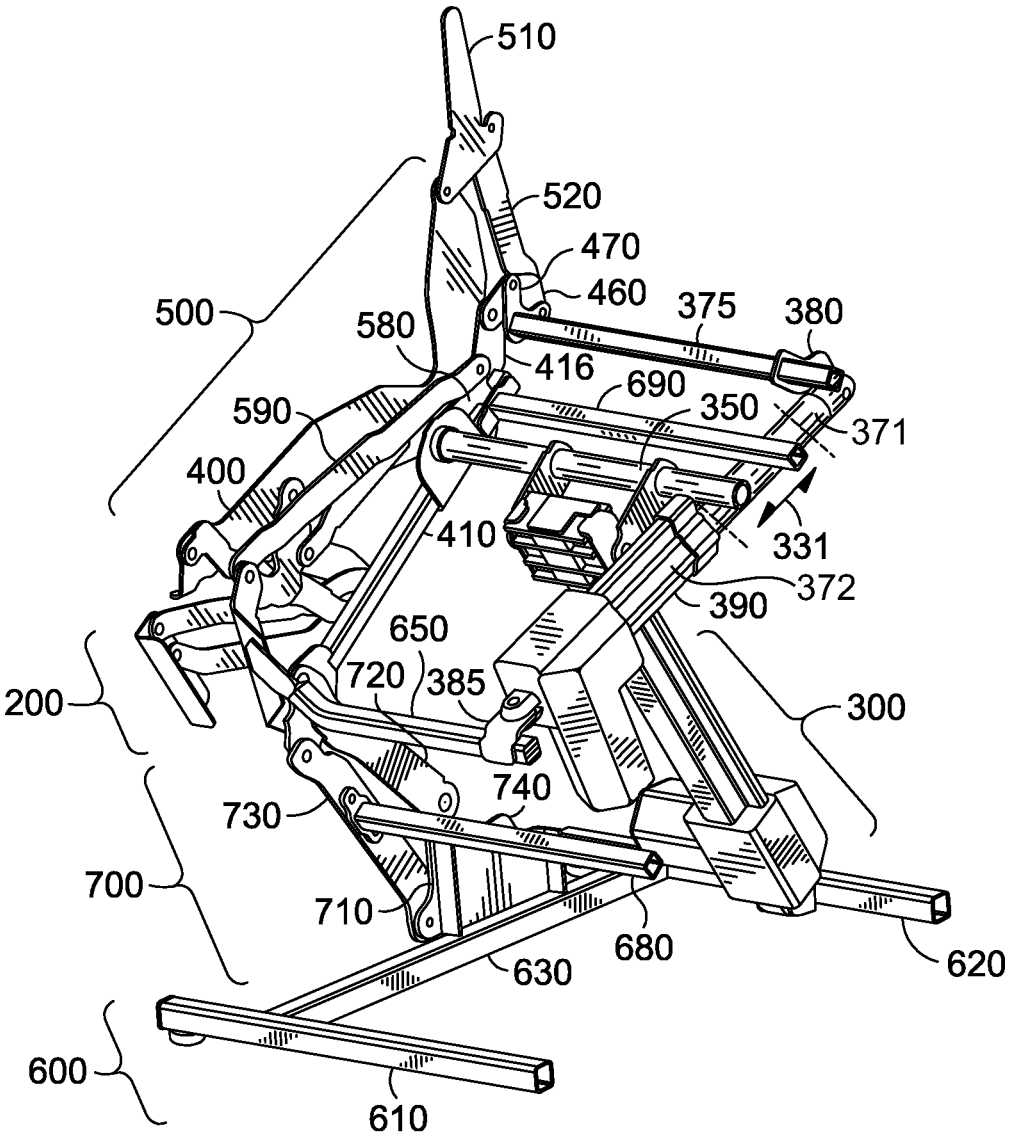
FIG. 8 is a view similar to FIG. 6, but in the seat-lift position, in accordance with an embodiment of the present invention.

Referring to FIGS. 6 and 8, a second linear actuator of the duel-motor design will now be discussed via the embodiments below. In an exemplary embodiment, the linkage mechanism 100 is coupled to the second linear actuator of the second motor assembly 370, which provides powered adjustment of the linkage mechanism 100 between the extended and the reclined positions. The second motor assembly 370 includes a second motor tube 375, second motor rear bracket 380, an extendable element 371, a second motor mechanism 372, a second front motor bracket 385, and a stabilizer tube 650. Typically, the second motor mechanism 372 (e.g., electric, hydraulic, or pneumatic cylinder head) and the extendable element 371 (e.g., piston) are slidably connected to each other such that extendable element 371 repositions over a first travel section (see reference numeral 331 of FIG. 8) with respect to the second motor mechanism 372 in a linear fashion. Generally, the extendable element 371 is pivotably coupled to the second motor tube 375 via the second motor rear bracket 380, thereby allowing for controlling rotation of the rear bellcrank 460 using the second linear actuator 390. The second motor mechanism 372 is attached to the stabilizer tube 650 via the second front motor bracket 385, thereby holding the second motor mechanism 372 substantially stationary relative linkage mechanism 100 while the extendable element is extended or retracted.

In one embodiment, both "linear actuators" may be configured similarly. In another embodiment, the first linear actuator may be comprised of the first motor mechanism 320, the track 330, and the motor activator block 340, while the second linear actuator 390 may be comprised of the second motor mechanism 372 that linearly extends or retracts the extendable element 371. In yet another embodiment, the first linear actuator may be configured with a motor mechanism that linearly extends or retracts an extendable element over two or more travel sections, while the second linear actuator may be configured as a third type of automated device (e.g., beta-slide bracket).

Therefore, although various different configurations of the linear actuators have been described, it should be understood and appreciated that other types of suitable devices and/or machines that automatically translate a component may be used, and that embodiments of the present invention are not limited to track-type and piston-type actuators described herein. For instance, embodiments of the present invention contemplate systems that are configured to adjust linkages in a nonlinear path or in multiple directions, respectively. Further, embodiments of the present invention considers such features employed by the linear actuators, such as variable rates of movement that are dynamically adjusted as a function of a number of factors.

As discussed above, the activator shaft 350, the second motor tube 375, and the stabilizer tube 650 span between and couple together the linkage mechanism 100 shown in FIGS. 5-8 and its counterpart, minor-image linkage mechanism (not shown). In embodiments, the activator shaft 350, the second motor tube 375, and the stabilizer tube 650 function as respective crossbeams that may be fabricated from metal stock (e.g., formed sheet metal). Similarly, a seat-mounting plate 400, a base plate 410, and a plurality of other links that comprise the linkage mechanism 100 may be formed from metal stock, such as stamped, formed steel. However, it should be understood and appreciated that any suitable rigid or sturdy material known in the furniture-manufacturing industry may be used in place of the materials described above.

Along these lines, in an exemplary embodiment, the base plates 410 may be fabricated from a straight tube with plate-type brackets (front base plate 415 and rear base plate 416) fixedly attached (e.g., welded or fastened) on each end. As illustrated in FIGS. 5 and 6, the front base plate 415 is fixedly attached to a forward portion 411 of the base plate 410 while the rear base plate 416 is fixedly attached to a rearward portion 412 of the base plate 410. In particular instances, the straight tube is constructed with a generally rectangular or square cross-section. Using a straight-tube design for the majority of the base plate 410, as opposed to a flat-plate configuration, helps minimize material and weight of the base plate 410 while, at the same time, increases torsional strength along the length of the base plate 410. Further, the straight-tube design provides a simple and strong attachment means (e.g., flat weld surface or parallel walls for receiving fasteners) for receiving the activator mounting plate 360 and for mating to the rear cross tube 690, which spans and couples the pair of substantially parallel-spaced base plates. In one example, self-tapping bolts may be installed to the straight tube in a substantially vertical direction to attach the activator mounting plate 360 and the rear cross tube 690 to the base plate 410, thereby enhancing ease of assembly, improving consistency in the assembly positions when coupling components of the linkage mechanism 100, and for imposing minimal shearing stress on the self-tapping bolts.

In operation of the first linear actuator, the motor activator block 340 travels toward or away from the first motor mechanism 320 along the track 330 during automated adjustment. In a particular embodiment, the first motor mechanism 320 causes the motor activator block 340 to longitudinally traverse, or slide, along the track 330 under automated control. This sliding action produces a rotational and/or lateral force on the front motor bracket 325, which, in turn, generates movement of the linkage mechanism 100 via the activator shaft 350. As more fully discussed below, the sliding action is sequenced into a second phase and a third phase.

In operation of the second linear actuator 390, the extendable element 371 travels toward or away from the second motor mechanism 372 during automated adjustment. In a particular embodiment, the second motor mechanism 372 causes the extendable element 371 to linearly traverse, or slide, under automated control. This sliding action produces a rotational and/or lateral force on the second rear bracket 380, which, in turn, generates movement of the linkage mechanism 100 via the second motor tube 375. As more fully discussed below, the sliding action is represented by the first phase.

In an exemplary embodiment, the first phase, the second phase, and the third phase are mutually exclusive in stroke. In other words, the second-linear-actuator stroke of the first phase fully completes before the first-linear-actuator stroke of the second phase commences, and vice versa. Likewise, the first-linear-actuator stroke of the second phase fully completes before the first-linear-actuator stroke of the third phase commences, and vice versa.

In a particular embodiment of the pair of linear actuators, the track 330 is operably coupled to the first motor mechanism 320 and includes a second travel section 332 and a third travel section 333, while the extendable element 371 is operable coupled to the second motor mechanism 372 and includes a first travel section 331. The motor activator block 340 translates longitudinally along the track 330 under automated control of the first motor mechanism 320 such that the motor activator block 340 translates within the second travel section 332 during the second phase and the third travel section 333 during the third phase. At other times (e.g., according to sequencing logic for separately controlling the first and second linear actuators), the extendable element 371 is linearly repositioned under automated control of the second motor mechanism 372 such that the extendable element 371 translates within first travel section 331 during the first phase.

Figure 12:
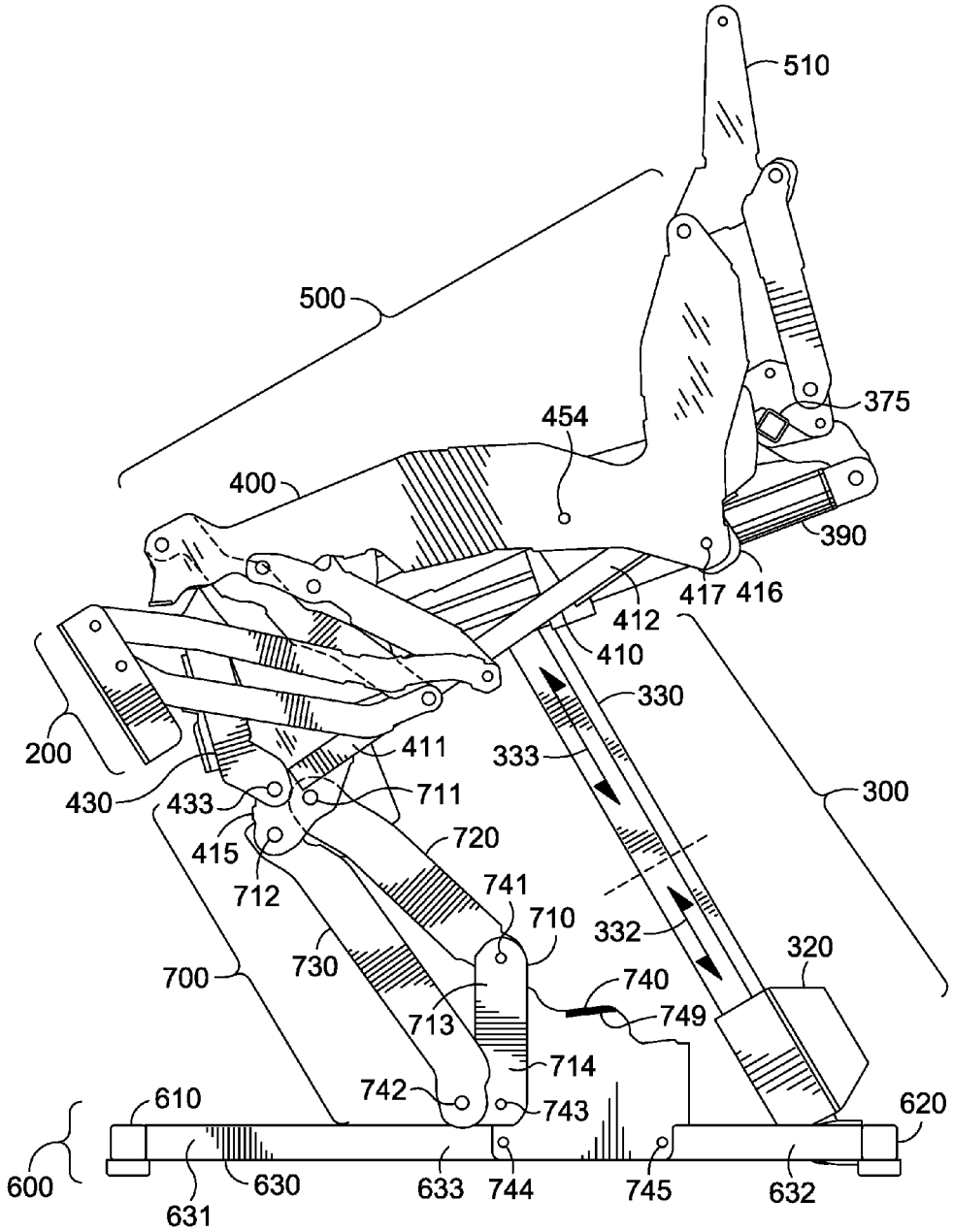
FIG. 12 is a view similar to FIG. 9, but in the seat-lift position, in accordance with an embodiment of the present invention.

As illustrated in FIGS. 7, 8, and 12, the dashed lines separating the first travel section 331, the second travel section 332, and the third travel section 333 indicate that the travel sections 332 and 333 abut, however, they do not overlap. Meanwhile, the first travel section 331 is managed separately from the travel sections 332 and 333 and may overlap movement in one or more of the travel sections 332 and 333 in some instances. It should be realized that the precise lengths of the travel sections 331, 332, and 333 are provided for demonstrative purposes only, and that the length of the travel sections 331, 332, and 333, or ratio of the linear-actuator strokes allocated to each of the first phase, second phase, and third phase, may vary from the length or ratio depicted.

Generally, the first phase involves linearly repositioning the extendable element 371 along the first travel section 331, which generates a first rotational movement (over a first angular range) of the second motor tube 375 with respect to the base plate 410. The rotation of the rear bellcrank 460 (pivotably coupled directly or indirectly to the base plate 410) converts the rotation movement to a lateral thrust on the back-support link 520 that invokes first-phase movement. This first-phase movement controls adjustment of the seat-adjustment assembly 500 between the reclined position (see FIG. 11) and the extended position (see FIG. 10). Further, during the first phase, extendable element 371 moves forward and rearward with respect to the lift-base assembly 600, while the second motor mechanism 372 remains generally fixed in space.

Once the stroke of the first phase is substantially complete, the second phase may occur. Generally, the second phase involves longitudinal translation of the motor activator block 340 along the second travel section 332 of the track 330. This translation within the second travel section 332 generates a second rotational movement (over a second angular range adjoining the first angular range) of the activator shaft 350 with respect to the activator mounting plate 360 at the front motor bracket 325, thereby invoking second-phase movement of the linkage mechanism 100. Generally, the rotational interface at the activator mounting plate 360 converts the rotation movement of the activator shaft 350 to a lateral thrust that invokes the second-phase movement. The second-phase movement controls adjustment of (extends or retracts) the footrest assembly 200 between the extended position (see FIG. 10) and the closed position (see FIG. 9). Typically, during the stroke of the first linear actuator within the second phase, the motor activator block 340 again forward and upward with respect to the lift-base assembly 600 while the first motor mechanism 320 remains generally fixed in space.

Figure 9:
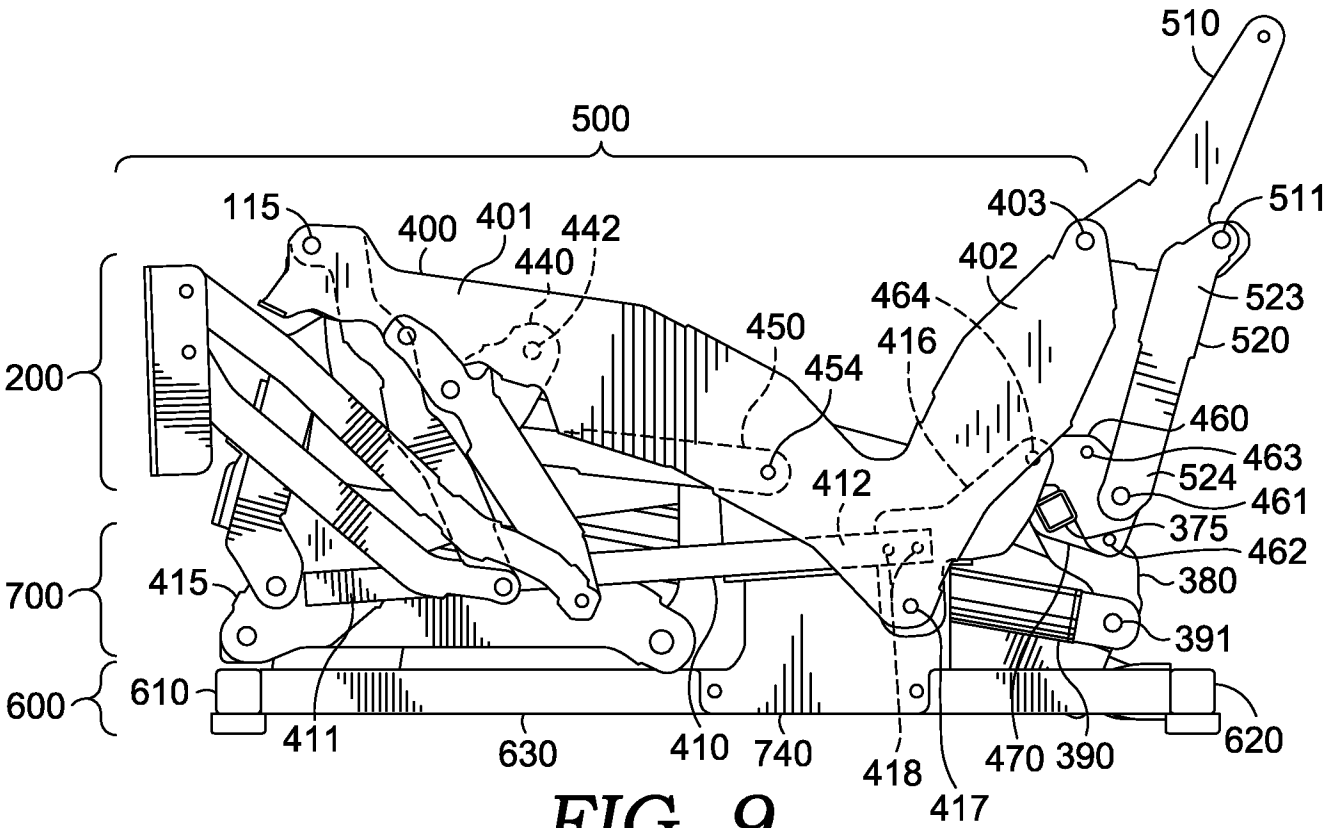
FIG. 9 is a diagrammatic lateral view of the linkage mechanism in the closed position from a vantage point external to the seating unit, in accordance with an embodiment of the present invention.
Figure 10:
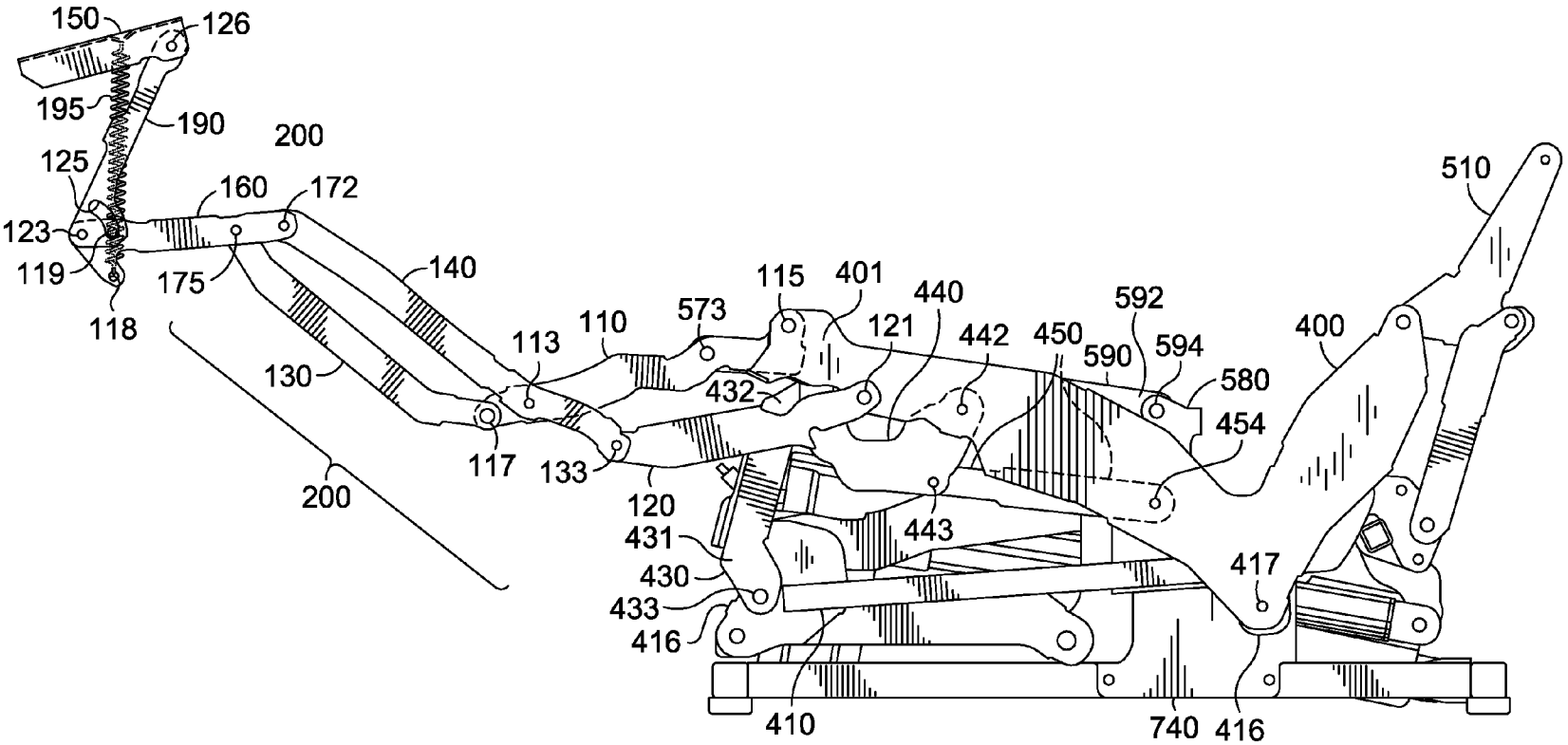
FIG. 10 is a view similar to FIG. 9, but in the extended position, in accordance with an embodiment of the present invention.
Figure 11:
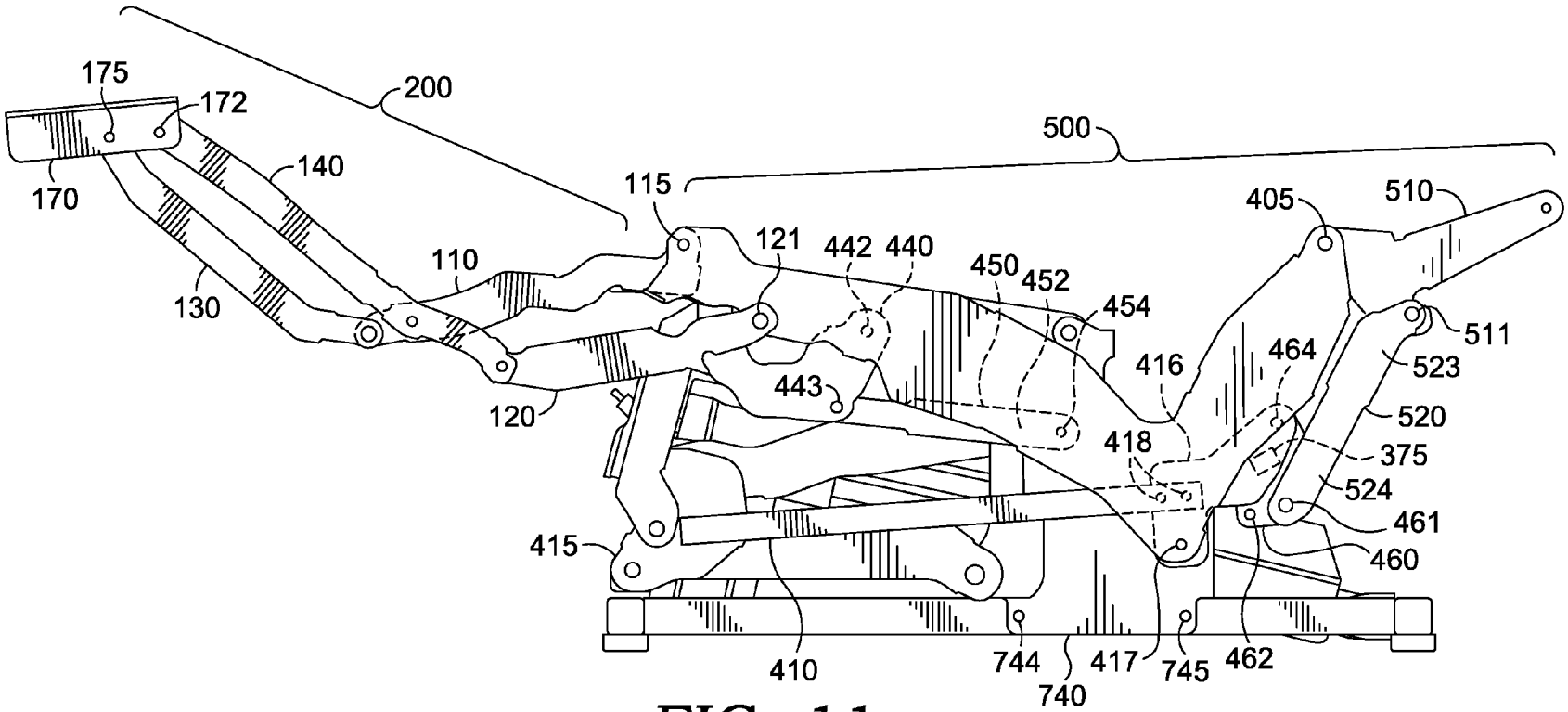
FIG. 11 is a view similar to FIG. 9, but in the reclined position, in accordance with an embodiment of the present invention.

In an exemplary embodiment, the first phase of movement includes the first range of degrees of angular rotation of the second motor tube 375 that does not intersect the second range of degrees included within the second phase of movement of the activator shaft 350. Further, the first and second phase may be sequenced into specific movements of the linkage mechanism 100. In embodiments, a weight of an occupant seated in the seating unit and/or springs interconnecting links of the seat-adjustment assembly 500 may assist in creating the sequence. Accordingly, the sequence ensures that adjustment of the footrest assembly 200 between the closed and extended positions is not interrupted by an adjustment of the backrest (attached to the back-mounting link 510), and vice versa. In other embodiments, as depicted in FIGS. 9-11, sequencing may be governed by logic integrated within a computing device, processor, or processing unit, where the logic is provided to control the sequenced adjustment of the seating unit, thereby segregating those linkage articulations assigned to the first phase of movement from the linkage articulations assigned to the second phase of movement.

Once a stroke of the second phase is substantially complete, the third phase occurs. During the third phase, the motor activator block 340 longitudinally translates forward and upward along the third travel section 333 of the track 330 with respect to the first motor mechanism 320, while the first motor mechanism 320 remains generally fixed in space. This longitudinal translation of the motor activator block 340 along the third travel section 333 creates a lateral thrust at the footrest drive bracket 580 but does not rotate the footrest drive bracket 580 because one or more links of the linkage mechanism 100 has encountered one or more stop elements attached thereto, thus, securing the linkage mechanism 100 in a detent condition. In one example of encountering a stop element, the angular rotation of the second range (during the second-phase movement) is completed upon a leading rear edge of a footrest drive bracket 580 contacting an upper surface of the straight tube comprising the base plate 410. At this point, additional rotation of the activator shaft 350 is limited by the impeded rotation of the footrest drive bracket 580.

Consequently, the longitudinal translation along the third travel section 333 of the track 330 generates a forward and upward lateral thrust at the activator shaft 350, which invokes adjustment of the lift assemblies 700 into or out of the seat-lift position (see FIG. 12) while maintaining the pair of linkage mechanisms 100 in the closed position. That is, the stroke of the third phase raises and tilts forward the linkage mechanism 100, with respect to the lift-base assembly 600, thus, adjusting the lift assembly 700 between a collapsed configuration and an expanded seat-lift position that facilitates entry and egress to the seating unit. As mentioned above, the raise and forward tilt of the linkage mechanism 100 during the third-phase movement does not translate fore or aft the seat with respect to the lift-base assembly 600, thus, maintaining the seat directly over a perimeter or profile formed by the members 610, 620, and 630 of the lift-base assembly 600 on the underlying surface.

In one instance, the first linear actuator and/or the second linear actuator 390 is embodied as electrically powered linear actuator(s). In this instance, the electrically powered linear actuator(s) are controlled by a hand-operated controller that provides instructions to the logic. The logic processes the instructions and sends appropriate commands to the respective linear actuator(s) based on one or more of the following parameters: a current position of the linkage mechanism 100; whether a phase of movement is currently in progress or partially complete; whether concurrent phases of movement are allowed (e.g., footrest assembly 200 extension while backrest recline; or a predefined ordering of the phases of movement that enforces consecutive positional adjustment.

Although various different parameters of that may be employed by the logic have been described, it should be understood and appreciated that other types of suitable configuration settings and/or rules (affecting how instructions initiated by a user-initiated actuation of the hand-operated controller are interpreted) may be utilized consistently or intermittently by the logic, and that embodiments of the present invention are not limited to the specific examples of parameters described herein. In one instance, embodiments of the present invention contemplate logic that is configured to perform the following steps: receive a request to recline a backrest; recognize that the second phase of movement is uncompleted; command the first linear actuator to extend the footrest assembly 200 to full extension; and commence the first phase of movement by commanding the second linear actuator 390 to recline the back-mounting link 510.

In another instance, the instructions, as interpreted via the logic, may cause the first and/or second linear actuator to carry out a complete second phase and/or first phase of movement, respectively, in an independent manner. Or, the instructions, as interpreted via the logic, may cause one or more of the linear actuators to partially complete the first phase and/or the second phase of movement. As such, the linear actuator(s) may be capable of being moved to and maintained at various positions within a stroke of the first phase or the second phase.

Although a particular configuration of the combination of the first linear actuator and the second linear actuator 390 has been described, it should be understood and appreciated that other types of suitable devices that provide sequenced adjustment may be used, and that embodiments of the present invention are not limited to the linear actuators described herein. For instance, the combination of the first motor mechanism 320, the track 330, and the motor activator block 340 may be embodied as a telescoping apparatus that extends and retracts in a sequenced manner.

Advantageously, the dual-motor lift mechanism (i.e., innovative interaction of the pair of linear actuators with the linkage mechanism 100) in embodiments of the present invention allows for a seating-unit manufacturer to employ various styling features to the linkage mechanism 100 (e.g., T-cushion style seat) that are not possible in a push-on-the-arm style mechanism utilized by conventional lifter recliners. Further, the dual-motor lift mechanism provides the benefits of reduced wall clearance. Yet, as discussed more fully below, the total cost for fabricating the linkages, assembling the linkages, and shipping the assemblies of the dual-motor lift mechanism is competitive or below conventional lifter recliners.

Turning to FIGS. 9-12, the components of the linkage mechanism 100 will now be discussed in detail. As discussed above, the linkage mechanism 100, which is raised and lowered by the lift assembly 700 (discussed below), includes the footrest assembly 200, the seat-mounting plate 400, the base plate 410, and the seat-adjustment assembly 500. The footrest assembly 200 includes a front ottoman link 110, a rear ottoman link 120, lower ottoman link 130, an upper ottoman link 140, and a footrest bracket 170. The front ottoman link 110 is rotatably coupled to a forward portion 401 of the seat-mounting plate 400 at pivot 115. The front ottoman link 110 is also pivotably coupled to the upper ottoman link 140 at pivot 113 and the lower ottoman link 130 at pivot 117. Further, the front ottoman link 110 may include a front stop element (not shown) fixedly attached at a mid section thereof that functions to resist continued extension of the footrest assembly 200 when the front stop element contacts a side of the upper ottoman link 140.

Referring to FIG. 5, the front ottoman link 110 is also pivotably coupled to a front end 591 of a footrest drive link 590 of the seat-adjustment assembly 500 at pivot 593. The footrest drive link 590 includes the front end 591 and a back end 592. The back end 592 of the footrest drive link 590 is pivotably coupled to a footrest drive bracket 580 at pivot 594. The footrest drive bracket 580 is fixedly attached to one of the ends of the activator shaft 350.

In operation, during adjustment of the seating unit between the closed position and the extended position, the first linear actuator causes the activator shaft 350 to rotate upon translating the motor activator block 340 over the second travel section 332 of the track 330. The rotation of the activator shaft 350 rotates the footrest drive bracket 580 forward (e.g., counterclockwise with respect to FIG. 5). This rotation of the footrest drive bracket 580 generates a forward lateral thrust of the footrest drive link 590, via the interaction at the pivot 594, that acts on the pivot 593 of the front ottoman link 110. The forward lateral thrust acting on the pivot 593 pushes outward on the front ottoman link 110 causing the front ottoman link 110 to rotate at the pivot 115 in a direction away from the seat-mounting plate 400 (e.g., clockwise with respect to FIG. 5) and, consequently, extend the footrest assembly 200.

Returning to the footrest assembly 200, in embodiments, the rear ottoman link 120 is rotatably coupled to the forward portion 401 of the seat-mounting plate 400 at pivot 121 and is pivotably coupled to the upper ottoman link 140 at pivot 133. In embodiments, the pivot 121 of the rear ottoman link 120 is slightly rearward of the pivot 115 of the front ottoman link 110. Further, with reference to the footrest assembly 200 at FIG. 11, the upper ottoman link 140 is pivotably coupled on one end to the rear ottoman link 120 at the pivot 133 and the front ottoman link 110 at the pivot 113. At an opposite end, the upper ottoman link 140 is pivotably coupled to the footrest bracket 170 at pivot 172. The lower ottoman link 130 is further pivotably coupled to the front ottoman link 110 at the pivot 117 and to the footrest bracket 170 at pivot 175. In embodiments, the footrest bracket 170 is designed to attach to ottoman(s), such as the foot-support ottoman 45, respectively. In a specific instance, as shown in FIG. 2, the footrest bracket 170 supports ottoman(s) in a substantially horizontal disposition when the footrest assembly 200 is fully extended upon completion of the second phase of movement.

A spring-loaded ottoman bracket 180 may be provided as an option in some models of the seating unit. As illustrated in FIG. 10, the footrest bracket 170 is replaced by the spring-loaded ottoman bracket 180 which includes a safety footrest bracket 150, a safety footrest mounting link 160, and a safety footrest pivot link 190, and a tension element 195 (e.g., spring link). The safety footrest mounting link 160 includes one end that is proximal to the footrest assembly 200 and another end that is distal to and extends outwardly from the footrest assembly 200. The proximal end of the safety footrest mounting link 160 is pivotably coupled to an upper end of the upper ottoman link 140 at the pivot 172 and is pivotably coupled to an upper end of the lower ottoman link 140 at the pivot 175, where the pivot 172 is located inward on the safety footrest mounting link 160 with respect to the pivot 175. The distal end of the safety footrest mounting link 160 is pivotably coupled to a lower end of the safety footrest pivot link 190 at pivot 123.

In embodiments, as illustrated in FIG. 10, a portion of the safety footrest pivot link 190 extends downwardly beyond the pivot 123 and includes a mounting location (e.g., aperture 118) for securing a first end of the tension element 195, while the balance of the safety footrest pivot link 190 extends upwardly above the pivot 123. An upper end of the safety footrest pivot link 190 is typically coupled to a rearward portion of the safety footrest bracket 150 at pivot 126. A mid portion of the safety footrest bracket 150 includes a mounting location for securing a second end of the tension element 195 that is opposed to the first end of the tension element that is secured to the aperture 118. In operation, the tension element 195 resides in tension between the respective mounting locations, where the tension exerts a linear force that urges the safety footrest bracket 152 remain in a generally parallel-spaced relationship with the safety footrest mounting link 160.

The safety footrest bracket 150 is configured for fixedly holding an ottoman, such as the foot-support ottoman 45 of FIG. 2. When the spring-loaded ottoman bracket 180 is extended along with the footrest assembly 200, the safety footrest bracket 150 holds the ottoman upward from the footrest assembly 200 in a substantially horizontal orientation, thereby providing heightened support for the legs of an occupant of the seating unit. When the spring-loaded ottoman bracket 180 is collapsed along with the footrest assembly 200, the safety footrest bracket 150 holds the ottoman against the footrest assembly 200 in a substantially vertical orientation such that the ottoman can serve as a front panel of the seating unit.

In embodiments, the safety footrest mounting link 160 includes a pin 119 (e.g., welded bushing or fastener) that is attached to and projects transversely from therefrom. The safety footrest pivot link 190 may include an arcuate slot 125 formed therein. The arcuate slot 125 may include an arc-shaped curvature that follows a consistent radius from the pivot 123. Also, the arcuate slot 125 maybe located on the lower end of the safety footrest pivot link 190 proximate to the pivot 123. Further, the arcuate slot 125 may receive a portion of the pin 119. In operation, physical contact between a first end of the arc-shaped curvature of the arcuate slot 125 and the pin 119 prevents additional counterclockwise rotation of the safety footrest pivot link 190 with respect to the footrest assembly 200 and further extension of the tension element 195. As the safety footrest pivot link 190 rotates clockwise with respect to the footrest assembly 200, the pin 119 travels within the arcuate slot 125 until meeting a second end of the arc-shaped curvature. Physical contact between the pin 119 in the second end of the arc-shaped curvature assists in resisting collapse of the spring-loaded ottoman bracket 180.

Turning to FIGS. 10 and 11, the seat-adjustment assembly 500, which reclines and inclines the backrest, will now be discussed. In embodiments, the seat-adjustment assembly 500 includes a front pivot link 430, a front lift link 440, a connector link 450, a rear bellcrank 460, a back-motor-tube bracket 470 for attaching to the second motor tube 375, a back-mounting link 510, a back-support link 520, the footrest drive bracket 580, and the footrest drive link 590. Initially, the back-mounting link 510 is rotatably coupled directly or indirectly to a rearward portion 402 of the seat-mounting plate 400 at pivot 405. In instances, the back-mounting link 510 may be configured to support a backrest of the seating unit. The back-support link 520 includes an upper end 523 and a lower end 524. The upper end 523 of the back-support link 520 is pivotably coupled to the back-mounting link 510 at pivot 511 while the lower end 524 of the back-support link 520 is pivotably coupled to the rear bellcrank 460 at pivot 461. The rear bellcrank 460 is pivotably coupled directly or indirectly to the rear base plate 416 or a rearward portion 412 of the base plate 410 at pivot 464. The back-motor-tube bracket 470 is fixedly attached to the rear bellcrank 460 at one or more connection points, such as locations 462 and 463. The back-motor-tube bracket 470 is responsible for securing the second motor tube 375 in a substantially perpendicular orientation such that the second motor tube 375 extends from the rear bellcrank 460 in an inward manner to reside below the seat as depicted in FIG. 6.

A mid section of the seat-mounting plate 400 is coupled to the rear base plate 416 or the rearward portion 412 of the base plate 410 at pivot 417. Also, the mid portion of the seat-mounting plate 400 is coupled to the connector link 450 at pivot 417. The connector link 450 includes a front end 451 and a rear end 452. The rear end 452 of the connector link 450 is pivotably coupled at the pivot 417 while the front end 451 of the connector link 450 is pivotably coupled with the front lift link 440 at a pivot 443, as depicted at FIG. 5.

As illustrated in FIGS. 5 and 10, the front lift link 440 is rotatably coupled to the forward portion 401 of the seat-mounting plate 400 at pivot 442. Further, the front lift link 440 is pivotably coupled to the front end 451 of the connector link 450 at the pivot 443 while the front pivot link 430 is pivotably coupled to the front lift link 440 at pivot 441. The front pivot link 430 includes an upper end 432 and a lower end 431. The upper end 432 of the front pivot link 430 is pivotably coupled to the front lift link 440 at the pivot 441, while the lower end 431 of the front pivot link 430 is pivotably coupled to the front base plate 415 or the forward portion 411 of the base plate 410 at pivot 433. That is, as discussed above, the base plate 410 may be formed of a single member (e.g., square straight tube) or may be composed of a plurality of formed plates.

As mentioned above, with respect the second phase of movement, the footrest drive bracket 580 and the footrest drive link 590 interact to propel the footrest assembly 200 forward, via a directional force on the pivot 593 of front ottoman link 110, or to retract the footrest assembly 200 rearward. The footrest drive bracket 580 is fixedly attached to one of the ends of the activator shaft 350. As illustrated in FIG. 5, the footrest drive bracket 580 is fixedly attached to the right end of the activator shaft 350 in a location outward of the rotational interface at the activator mounting plate 360. However, the precise location of the fixed attachment of the footrest drive bracket 580 to the activator shaft 350 may vary. For instance, embodiments of the present invention consider a location of the fixed attachment of the footrest drive bracket 580 to be inward of the rotation interface at the activator mounting plate 360.

Typically, the footrest drive link 590 includes the front end 591 and the back end 592. The back end 592 of the footrest drive link 590 is pivotably coupled to an arm of the footrest drive bracket 580 extending radially from the activator shaft 350 at the pivot 594. The front end 591 of the footrest drive link 590 is pivotably coupled to the front ottoman link 110 of the footrest assembly 200 at the pivot 593. In operation, the first linear actuator's angular rotation of the activator shaft 350 directly affects the extended or collapsed configuration of the footrest assembly via the articulating interaction of the footrest drive link 590 and the footrest drive bracket 580.

With reference to FIGS. 6 and 10, the lift assembly 700 will now be discussed. The lift assembly 700 includes the riser connector plate 710, an upper lift link 720, a lower lift link 730, and the lift bracket 740. The lift assembly 700 is fixedly attached to a minor-image lift assembly (not shown) via a front cross tube 680, where one end of the front cross tube 680 may be fixedly attached to the lower lift link 730 directly or via intervening hardware (e.g., bracket 681). As discussed more fully above, the rear cross tube 690 spans and couples the base plate 410 with a complimentary base plate on the mirror-image linkage mechanism (not shown). In embodiments, the front cross tube 680 and the rear cross tube 690 may be formed from square metal tubing and may function as a set of crossbeams that rigidly secure the right linkage mechanism 100 and the left minor-image linkage mechanism in parallel-spaced relation.

In embodiments, the lift assembly 700 (shown) is fixedly attached to the right longitudinal member 640 of the lift-base assembly 600 via the lift bracket 740 at connection points 744 and 745, while the minor-image lift assembly (not shown) is fixedly attached to the left longitudinal member 630. Additionally, the riser connector plate 710 is fixedly attached to the lift bracket 740 via the connection point 743. As discussed more fully above, the connection point 743 allows for mounting the linkage mechanism 100 to the lift-base assembly 600 with only one fastener (e.g., shoulder bolt), thus, simplifying the assembly process of attaching the linkage mechanism 100 to the lift-base assembly 600 such that assembly may be easily performed subsequent to shipping on the premise of a seating-unit manufacturer.

Turning to FIG. 10, the internal connections of the lift assembly 700 will now be discussed. In embodiments, the riser connector plate 710 is fixedly attached to a respective longitudinal member of the lift-base assembly 600 via the lift bracket 740 at connection point 743. Also, the riser connector plate 710 includes an upper end 713 and a lower end 714. The upper lift link 720 is pivotably coupled at one end to the front base plate 415, or forward portion 411 of the base plate 410, at pivot 711. The upper lift link 720 is also rotatably coupled at another end to the upper end 713 of the riser connector plate 710 at pivot 741. The lower lift link 720 is pivotably coupled at one end to the front base plate 415, or forward portion 411 of the base plate 410, at pivot 712. In embodiments, the pivot 712 is forward of and proximate to the pivot 711. The lower lift link 720 is rotatably coupled at another end to the lower end 714 of the riser connector plate 710 at pivot 742.

In operation, the lift links 720 and 730 are configured to swing in a generally parallel-spaced relation when the linear actuator adjusts the seating unit into and out of the seat-lift position. Further, the configuration of the lift links 720 and 730 allow the base plate 410 to move in a path that is upward and tilted forward when adjusting to the seat-lift position of FIG. 10. As discussed above, movement into and out of the seat-lift position occurs in the third phase of the linear-actuator stroke in which the motor activator block 340 longitudinally traverses the track 330 within the third travel section 333.

Generally, the lift assembly 700 is designed such that there exists a relatively small amount of contact area between linkage mechanism 100 and the lift-base assembly 600. In particular embodiments, the entire contact area includes a forward region and a rearward region. The forward region is located along the front lateral member 610 where the front base plate 415 and/or an edge of the lower lift link 730 meets an upper surface of the front lateral member 610 when the seating unit is not adjusted to the seat-lift position. The rearward region is located at the top of the lift bracket 740, which is welded to the lift-base assembly 600. The rearward region of the contact area is high above the a frame comprising the lift-base assembly 600, thereby greatly minimizing any potential for a rear pinch point as the seating unit lowers downward to the closed position. By removing positional for the rear pinch point, harm to fingers, pets, or power cables to the linear actuators are avoided.

The operation of the seat-adjustment assembly 500 will now be discussed with reference to FIGS. 10 and 11. Initially, an occupant of the seating unit may invoke an adjustment from the reclined position (FIG. 11) to the extended position (FIG. 10) in an effort to sit upright for viewing television. In an exemplary embodiment, the occupant may invoke an actuation at a hand-operated controller that sends a control signal with instructions to a processor that hosts logic. The logic may interpret the instructions to incline the backrest and, if the sequencing parameters allow, send a command to the second linear actuator 390 to invoke movement in the first phase. As discussed above, the second linear actuator 390 may move in a sequenced manner, which may be enforced by a weight of the occupant, a placement of springs within the seat-adjustment assembly 500. Typically, the movement of the second linear actuator 390 is sequenced in coordination with the first linear actuator of the first motor assembly 300, where sequencing may involve three substantially independent strokes: the first phase (adjusting between the reclined and extended positions), the second phase (adjusting between the extended and closed positions), and the third phase (adjusting into and out of the seat-lift position (see FIG. 12) while the linkage mechanism 100 resides in the closed position).

In one embodiments, upon receiving the control signal from the hand-operated controller when the linkage mechanism 100 resides in the reclined position, the logic may command the second linear actuator 390 to carry out a stroke in the first phase. That is, with reference to FIG. 8, the second linear actuator 390 slides the extendable element 371 rearward with respect to the lift-base assembly 600 (over the first travel section 331), while holding the second motor mechanism 372 relatively fixed in space. This sliding action of the extendable element 371 invokes first-phase movement (angular rotation over a first range of degrees) at the rear bellcrank 460 about the pivot 464, which rotatable couples the rear bellcrank 460 to the base plate 410.

In an exemplary embodiment, linear rearward repositioning of the extendable element 371 over the first travel section 331 causes counterclockwise rotation of the second motor tube 375. Because the second motor tube 375 is fixedly attached to the rear bellcrank 460, the counterclockwise rotation is transferred to the rear bellcrank 460. The counterclockwise rotation of the rear bellcrank 460 about the pivot 464 is transferred to the back-support link 520 as an upward longitudinal thrust. As the back-support link 520 moves longitudinally upward, the directional force is transmitted to the back-mounting link 510 at the pivot 511. The directional force causes the back-mounting link 510 to rotate counterclockwise about the pivot 405, thereby inclining the backrest attached directly or indirectly to the back-mounting link 510.

As seen in the adjustment from the configuration of FIG. 11 (reclined position) to the configuration of FIG. 12 (extended position), the rotation of the second motor tube 375 generated by controlled actuation of the second linear actuator 390 does not influence a position of the seat-mounting plate 400 in relation to the base plate 410. That is, as opposed to conventional linkage systems, the seat-mounting plate 400 does not move upward or forward with respect to the base plate 410. As a result, the seat-mounting plate 400, as well as the seat, remains in a consistent angle of inclination during adjustment between the reclined position and the extended position.

Eventually, the rotation of the second motor tube 375 and, consequently, the rear bellcrank 460 is ceased upon the second linear actuator 390 reaching the end of the first travel section 331. At this point, adjustment from the reclined position to the extended position is substantially complete. Adjustment from the extended position to the reclined position operates substantially similar, but in reverse, to the steps described above.

The operation of the footrest assembly 200 will now be discussed with reference to FIGS. 9 and 10. As discussed above, when desiring to move from the extended position (FIG. 10) to the closed position (FIG. 9), the occupant may invoke an actuation at the hand-operated controller that sends the control signal with instructions to the first linear actuator of the first motor assembly 300 to carry out a stroke in the second phase. Upon receiving the control signal from the hand-operated controller, the logic may command the first linear actuator to slide the motor activator block 340 forward and upward with respect to the lift-base assembly 600 (over the second travel section 332) while holding the first motor mechanism 320 relatively fixed in space. This sliding action of the motor activator block 340 rotates the footrest drive bracket 580 about the rotational interface with the activator mounting plate 360. This clockwise rotation of the footrest drive bracket 580 triggers second-phase movement (angular rotation over a second range of degrees) at the footrest drive bracket 580.

This second-phase movement of the footrest drive bracket 580 pulls the footrest drive link 590 rearward a particular distance, which attempts to cause the seat-mounting plate 400 to translate over the base plate 410 in a rearward manner (via the pivot 593). However, the seat-mounting plate 400 is blocked from translating rearward over the base plate 410 due to the pivot 417 that couples the mid section of the seat-mounting plate 400 to the rear base plate 416 or the rearward portion 412 of the base plate 410.

Yet, the second-phase movement (angular rotation over a second range of degrees) of the footrest drive bracket 580 serves to translate the footrest drive link 590 rearward, thereby generating a rearward directional force at the pivot 593. This rearward translation of the footrest drive link 590 pulls the front ottoman link 110 downward about the pivot 115 and rotates the rear ottoman link 120 downward about the pivot 121 via the upper ottoman link 140. Further, the front ottoman link's 110 downward rotation about the pivot 115 produces a downward and rearward force on the lower ottoman link 130 and, indirectly, the other links 120, 140, and 170, which pulls them toward the lift-base assembly 600. In one instance, this downward and rearward force on the front ottoman link 110 removes the front ottoman link 110 from contact with a stop element that serves to limit the extension of the footrest assembly 200. As such, the foot-support ottomans are retracted to a position substantially below a front edge of the seat. Also, similar to the adjustment in the first phase, the second-phase movement of the first linear actuator generates clockwise rotation of the footrest drive bracket 580. Eventually, the clockwise rotation of the footrest drive bracket 580 is resisted upon a side of the footrest drive bracket 580 contacting a top surface of the base plate 410, as shown in FIG. 6. At this point, adjustment from the extended position to the closed position is substantially complete.

In a manner that is reverse to the steps discussed above, with reference to operation of the footrest assembly 200 from the closed position to the extended position, the automated force of the linear actuator upon the footrest drive bracket 580 in the first phase of the linear-actuator stroke forces the footrest drive link 590 forward, which, in turn, rotates the front ottoman link 110 about the pivot 115. This rotation acts to extend the footrest assembly 200 and causes the other links 120, 130, 140, and 170 to move upwardly and/or rotate in a clockwise direction, with reference to FIG. 8. Also, the footrest bracket 170 is raised and rotated in a clockwise fashion such that the ottoman(s) 45 (see FIGS. 1-3) are adjusted from a collapsed, generally vertical orientation to an extended, generally horizontal orientation. Extension of the footrest assembly is restrained upon the front ottoman link 110 coming into contact with a stop element or another detention feature.

It should be understood that the construction of the linkage mechanism 100 lends itself to enable the various links and brackets to be easily assembled and disassembled from the remaining components of the seating unit. Specifically the nature of the pivots and/or mounting locations, allows for use of quick-disconnect hardware, such as a knock-down fastener. Accordingly, rapid disconnection of components prior to shipping, or rapid connection in receipt, is facilitated.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A seating unit having a chassis, a seat, a backrest, and at least one foot-support ottoman, the seating unit being adapted to move between a closed, an extended, a reclined, and a seat-lift position, the seating unit comprising:

a lift-base assembly for supporting the seating unit on underlying surface;

a pair of base plates in substantially parallel-spaced relation, wherein each base plate includes a tubular portion, a first plate coupled to a forward portion of the tubular portion, and a second plate that is coupled to a rearward portion of the tubular portion;

a pair of lift assemblies, wherein each of the lift assemblies is attached to a respective base plate and raises and lowers the respective base plate directly above the lift-base assembly;

a pair of seat-mounting plates in substantially parallel-spaced relation, wherein the seat-mounting plates suspend the seat over the lift assemblies and wherein each seat-mounting plate is attached to a respective second plate of a respective base plate;

a pair of generally mirror-image linkage mechanisms each moveably interconnecting each of the base plates to a respective seat-mounting plate, wherein each of the linkage mechanisms comprise:

(a) a footrest assembly that extends and retracts the at least one foot-support ottoman; and (b) a seat-adjustment assembly that reclines and inclines the backrest;

a first linear actuator that provides automated adjustment of the seating unit between the closed position, the extended position, and the seat-lift position, wherein the first linear actuator is configured to move the lift assemblies into and out of the seat-lift position while maintaining the linkage mechanisms in the closed position and while consistently maintaining the seat-mounting plates inside a footprint of the lift-base assembly; and a second linear actuator that provides automated adjustment of the seating unit between the extended position and the reclined position.

2. The seating unit of claim 1, wherein the second linear actuator comprises an extendable element that includes a first travel section, and wherein the first linear actuator comprises:

a first motor mechanism;

a track operably coupled to the first motor mechanism, wherein the tract includes a second travel section, and a third travel section; and a motor activator block that translates longitudinally along the track under automated control;

wherein adjustment of the seating unit is sequenced into a first phase, a second phase, and a third phase that are mutually exclusive in stroke; and wherein the first phase moves the seat-adjustment assembly between the reclined position and the extended position when the extendable element of the second linear actuator is repositioned over the first travel section.

3. The seating unit of claim 2, wherein the second phase moves the footrest assembly between the extended position and the closed position when the motor activator block is translated over the second travel section of the track.

4. The seating unit of claim 3, wherein the third phase moves the lift assemblies into and out of the seat-lift position when the motor activator block is translated over the third travel section of the track.

5. The seating unit of claim 4, further comprising an activator shaft that spans between and couples to the linkage mechanisms, wherein the activator shaft has a pair of ends, wherein one of the ends of the activator shaft is rotatably coupled to a respective base plate via an activator mounting plate, and wherein the motor activator block is directly or indirectly coupled to the activator shaft.

6. The seating unit of claim 5, wherein the seat-adjustment assembly comprises:

a footrest drive bracket that is fixedly attached to one of the ends of the activator shaft; and a footrest drive link that includes a front end and a back end, wherein the footrest drive bracket is pivotably coupled to the back end of the footrest drive link and the front end of the footrest drive link is pivotably coupled to the footrest assembly.

7. The seating unit of claim 6, wherein the footrest assembly comprises a front ottoman link that is rotatably coupled to a forward portion of a respective seat-mounting plate, and wherein the front end of the footrest drive link is pivotably coupled to the front ottoman link.

8. The seating unit of claim 7, wherein adjusting the seating unit between the closed position and the extended position involves causing the activator shaft to rotate upon translating the motor activator block over the second travel section of the track, wherein the rotation of the activator shaft generates a forward or rearward thrust at the front ottoman link via the interaction of the footrest drive link and the footrest drive bracket.

9. The seating unit of claim 8, wherein the lift-base assembly comprises:

a front lateral member;

a rear lateral member that is oriented in substantially parallel-spaced relation to the front lateral member;

a left longitudinal member; and a right longitudinal member that is oriented in substantially parallel-spaced relation to the left longitudinal member, wherein the left and right longitudinal members span and couple the front and rear lateral members, and wherein the left and right longitudinal members and the front and rear lateral members represent a perimeter of the footprint of the lift-base assembly.

10. The seating unit of claim 9, wherein the motor activator block is pivotably coupled to a section between a pair of ends of the rear lateral member via a rear motor bracket, and wherein, during the stroke of the linear actuator within the second phase, the motor activator block moves forward and upward with respect to the lift-base assembly while the first motor mechanism remains generally fixed in space.

11. The seating unit of claim 10, wherein the second phase involves longitudinal translation of the motor activator block along the second travel section that creates a moment of rotation about the activator shaft via one or more front motor brackets, wherein the one or more front motor brackets are pivotably coupled to the motor activator block and fixedly attached to the activator shaft.

12. The seating unit of claim 11, wherein the third phase involves longitudinal translation of the motor activator block along the third travel section that creates a lateral thrust at the activator bar, thereby invoking adjustment of the lift assemblies into or out of the seat-lift position while maintaining the pair of linkage mechanisms in the closed position.

13. The seating unit of claim 12, wherein, during the stroke of the linear actuator within the third phase, when adjusting the lift assemblies into the seat-lift position, the motor activator block moves forward and upward with respect to the lift-base assembly while the motor mechanism remains generally fixed in space.

14. The seating unit of claim 13, wherein each of the lift assemblies comprise:

a riser connector plate that is fixedly attached to a respective longitudinal member of the lift-base assembly, the riser connector plate having an upper end and a lower end;

an upper lift link that is pivotably coupled at one end to a respective base plate and is rotatably coupled at another end to the upper end of the riser connector plate; and a lower lift link that is pivotably coupled at one end to a respective base plate and is rotatably coupled at another end to the lower end of the riser connector plate.

15. A chair-adjustment mechanism adapted to move a seating unit between a reclined, an extended, a closed, and a seat-lift position, the chair-adjustment mechanism comprising:

a pair of generally minor-image linkage mechanisms, each linkage mechanism comprising:

a seat-mounting plate that includes forward portion and a rearward portion and that fixedly mounts to a seat;

a base plate that includes a forward portion, a mid portion, and a rearward portion;

a footrest assembly that extends and retracts at least one foot-support ottoman;

a seat-adjustment assembly coupled to the seat-mounting plate and the base plate comprising:

(a) a rear bellcrank that is pivotably coupled directly or indirectly to the rearward portion of the base plate;

(b) a back-mounting link that pivotably coupled directly or indirectly to the rearward portion of the seat-mounting plate;

(c) a back-support link that has an upper end and a lower end, wherein the upper end of the back-support link is pivotably coupled to the back-mounting link, and wherein the lower end of the back-support link is pivotably coupled to the rear bellcrank; and (d) a second motor tube that is fixedly attached directly or indirectly to the rear bellcrank, wherein the second motor tube extends substantially perpendicular to the rear bellcrank in an inward manner to attach the generally minor-image linkage mechanisms;

a lift assembly attached to each base plate of the pair of generally minor-image linkage mechanisms;

a first linear actuator that provides automated adjustment of the chair-adjustment mechanism between the closed position, the extended position, and the seat-lift position, wherein a first-linear-actuator adjustment is sequenced into a second phase and a third phase, wherein the second phase moves the footrest assembly between the extended position and the closed position, and wherein the third phase moves the lift assembly into and out of a seat-lift position while maintaining the pair of linkage mechanisms in the closed position; and a second linear actuator that provides automated adjustment of the chair-adjustment mechanism between the extended position and the reclined position, wherein the second-linear-actuator adjustment involves a first phase that is sequenced with the second phase and the third phase such that the first, second, and third phases are substantially mutually exclusive in stroke, wherein the first phase moves the seat-adjustment assembly between the reclined position and the extended position.

16. The linkage mechanism of claim 15, further comprising an activator shaft having a pair of ends, wherein one of the ends of the activator shaft is rotatably coupled directly or indirectly to the mid portion of the base plate.

17. The linkage mechanism of claim 16, wherein the second linear actuator comprises:

a second motor mechanism attached to a stabilizer tube, wherein the stabilizer tube is fixedly attached directly or indirectly to the forward portion of the base plate, and wherein the stabilizer tube extends substantially perpendicular to the base plate in an inward manner; and an extendable element that linearly extends and retracts with respect to the second motor mechanism during the first phase, wherein the extendable element is pivotable coupled to the second motor tube.

18. The linkage mechanism of claim 15, wherein first-phase adjustment of the second linear actuator causes the rear bellcrank to bias within a first range of degrees via the second motor tube, wherein the second-phase adjustment of the first linear actuator causes the activator shaft to angularly bias within a second range of degrees that does not overlap the first range of degrees, wherein the angular bias within the first range of degrees generates movement of the seat-adjustment assembly while maintaining the at least one foot-support ottoman in an extended orientation, and wherein the angular bias within the second range of degrees generates movement of the footrest assembly while maintaining the backrest in an inclined orientation.

19. An adjustment mechanism for a seating unit, the adjustment mechanism comprising:

a lift-base assembly for supporting the adjustment mechanism on an underlying surface;

a pair of base plates in substantially parallel-spaced relation, wherein each base plate includes a tubular portion, a first plate coupled to a forward portion of the tubular portion, and a second plate that is coupled to a rearward portion of the tubular portion;

a pair of lift assemblies, wherein each of the lift assemblies is attached to a respective base plate and moveably supports the respective base plate with respect to the lift-base assembly, wherein the lift assemblies are adapted to adjust the pair of base plates into and out of a seat-lift position;

a pair of seat-mounting plates in substantially parallel-spaced relation, wherein each of the seat-mounting plates is consistently disposed within a footprint of the lift-base assembly throughout movement of the adjustment mechanism, and wherein each of the seat-mounting plates is pivotably attached to a respective second plate of one of the base plates; and a pair of generally mirror-image linkage mechanisms each connected to a respective seat-mounting plate and base plate and aadapted to move the adjustment mechanism between a closed position, an extended position, and a reclined position, wherein each of the linkage mechanisms comprise:

(a) a back-mounting link rotatably coupled to a respective seat-mounting plate and configured to support a backrest of the seating unit;

(b) a rear bellcrank that is pivotably coupled directly or indirectly to a respective base plate;

(c) a back-support link that has an upper end and a lower end, wherein the upper end of the back-support link is pivotably coupled to the back-mounting link, and wherein the lower end of the back-support link is pivotably coupled to the rear bellcrank.

* * * * *